US006851770B2

(12) United States Patent
Canedy et al.

(10) Patent No.: US 6,851,770 B2
(45) **Date of Patent: *Feb. 8, 2005**

(54) DISPLAY CASE SECURITY APPARATUS HAVING LINEAR ACTUATOR

(75) Inventors: John F. Canedy, Rowlett, TX (US); Leo Faubion, Plano, TX (US)

(73) Assignee: Fausion Associates, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/456,359

(22) Filed: Jun. 6, 2003

(65) Prior Publication Data

US 2003/0209955 A1 Nov. 13, 2003

Related U.S. Application Data

(63) Continuation-in-part of application No. 10/369,332, filed on Feb. 18, 2003, which is a continuation of application No. 09/997,401, filed on Nov. 29, 2001, now Pat. No. 6,540,311.

(60) Provisional application No. 60/250,038, filed on Nov. 29, 2000.

(51) Int. Cl.[7] ..... A47F 3/00

(52) U.S. Cl. ..... 312/114; 312/312; 312/319.8

(58) Field of Search ..... 312/114, 117, 312/138.1, 294, 304, 306, 312, 319.5, 319.8, 350, 293.2; 109/45, 47

(56) References Cited

U.S. PATENT DOCUMENTS

| | | | |
|---|---|---|---|
| 145,378 | A | 12/1873 | Wilkins |
| 328,475 | A | 10/1885 | Ford |
| 1,441,763 | A | 1/1923 | Stinson |
| 1,949,954 | A | 3/1934 | Culler et al. |
| 1,990,300 | A | 2/1935 | Miller |
| 2,201,948 | A | 5/1940 | Watkins |

(List continued on next page.)

FOREIGN PATENT DOCUMENTS

| | | |
|---|---|---|
| DE | 45974 | 1/1911 |
| DE | 2202785 | 8/1973 |
| DE | 3613786 | * 11/1986 |

(List continued on next page.)

OTHER PUBLICATIONS

Magnetic Elek. AG; Telemag 24 V DC telescopic drives (brochure); Jun. 1997; 2 pg.

(List continued on next page.)

*Primary Examiner*—James O. Hansen
(74) *Attorney, Agent, or Firm*—Howison & Arnott, L.L.P.

(57) ABSTRACT

A display case security apparatus comprises a housing, a platform, an elevating mechanism, and a closure. The housing includes a lower storage section and an upper display section disposed above the storage section. The storage section has an opaque exterior wall and the display section has an exterior wall that is at least partially transparent. The platform is disposed within the housing and includes a generally horizontal portion for supporting articles to be displayed. The platform is selectively movable in the vertical direction between a first position, wherein any articles supported on the platform are in the display section of the housing, and a second position, wherein any articles supported on the platform are in the storage section of the housing. The elevating mechanism is mounted within the housing and includes a linear actuator that is selectively extendable along a straight line axis between a retracted position and an extended position. The linear actuator is connected between the housing and the platform and is positioned so that the straight line axis is oriented vertically. The platform moves between the first position and the second position when the linear actuator moves between the extended position and the retracted position, respectively. The closure is selectively interposed between the display section and the storage section when the platform is in the second position, enclosing the platform and any articles supported thereon within the storage section of the housing.

27 Claims, 18 Drawing Sheets

U.S. PATENT DOCUMENTS

| | | | | | |
|---|---|---|---|---|---|
| 2,284,531 | A | | 5/1942 | Miller et al. | |
| 2,456,429 | A | * | 12/1948 | Parsons | 91/533 |
| 2,569,254 | A | | 9/1951 | Page | |
| 2,687,934 | A | | 8/1954 | Gipple | |
| 3,805,962 | A | | 4/1974 | Bendiksen | |
| 4,022,137 | A | | 5/1977 | Chiu | |
| 4,369,717 | A | | 1/1983 | Bollier | |
| 4,942,328 | A | * | 7/1990 | Price | 312/306 |
| 5,129,611 | A | | 7/1992 | Grover et al. | |
| 5,165,768 | A | | 11/1992 | Zarrabi et al. | |
| 5,295,743 | A | | 3/1994 | Moulton et al. | |
| 5,450,800 | A | * | 9/1995 | Leonard | 108/7 |
| 5,483,905 | A | | 1/1996 | Johansoon | |
| 5,524,977 | A | | 6/1996 | Orawski | |
| 5,733,021 | A | | 3/1998 | O'Neill et al. | |
| 5,758,936 | A | | 6/1998 | Baughan | |
| 5,791,749 | A | | 8/1998 | O'Neill et al. | |
| 5,820,233 | A | | 10/1998 | Hahn | |
| 5,853,235 | A | | 12/1998 | Barnes | |
| 6,102,355 | A | | 8/2000 | Rood | |
| 6,361,131 | B1 | * | 3/2002 | Powell, Jr. | 312/312 |
| 6,540,311 | B2 | | 4/2003 | Canedy et al. | |
| 6,764,145 | B2 | * | 7/2004 | Canedy et al. | 312/114 |

FOREIGN PATENT DOCUMENTS

| | | | |
|---|---|---|---|
| EP | 0 521 728 | A1 | 1/1993 |
| FR | 2619695 | A1 | 3/1989 |
| FR | 2712785 | * | 6/1995 |
| GB | 668942 | | 3/1952 |
| JP | 52-7700 | | 1/1977 |
| JP | 408336449 | A | 12/1996 |

OTHER PUBLICATIONS

Magnetic Elek. AG; Telemag TLT dual DC–motor telescoping column . . . (brochure); 1998; 2 pg.

Magnetic Elek. AG; Telemag Telescopic drives . . . (brochure); Jun. 1998; 4 pg.

Magnetic Elek. AG; Telesmart TMA/TMD (brochure); Apr. 2001; 2 pg.

Magnetic Corp.; Sit/Stand Height Adjustment for Workstations (brochure); 1 pg.

* cited by examiner

DISPLAY CASE SECURITY APPARATUS HAVING LINEAR ACTUATOR

CROSS-REFERENCE TO RELATED APPLICATIONS

This application is a continuation-in-part of U.S. application Ser. No.10/369,332, titled "DISPLAY CASE SECURITY APPARATUS," filed Feb. 18, 2003, which is a continuation of U.S. application Ser. No. 09/997,401, titled "DISPLAY CASE SECURITY APPARATUS," filed Nov. 29, 2001, now issued as U.S. Pat. No. 6,540,311 B2, which is related to, and claims the benefits of priority from, U.S. Provisional Application No. 60/250,038, titled "DISPLAY CASE SECURITY APPARATUS," filed Nov. 29, 2000.

TECHNICAL FIELD OF THE INVENTION

This invention relates to a display case or cabinet having a movable platform for supporting valuable articles such as jewelry. In one aspect, it relates to a display case wherein the mechanism for selectively moving the platform between a display portion and a secure storage portion of the case includes a linear actuator.

BACKGROUND OF THE INVENTION

Display cases, also known as showcases, are widely used for displaying high-value articles such as jewelry, coins, electronics, cameras, etc. It is readily understood that the typical display case having one or more glass windows is particularly susceptible to theft wherein the criminal smashes the glass and removes as many valuable articles as possible before escaping. Due to the frequency of such "smash and grab" crimes, most retailers choose to remove high-value goods from their display cases at the close of business daily and relocate the merchandise into more secure storage. Unfortunately, the routine transfer of merchandise between the display case and storage causes many problems of its own, not the least of which is the increased labor required to perform the work. Other problems include increased wear and tear on the merchandise and display fixtures, and increase problems with inventory and loss control.

Accordingly, it would be of significant advantage to provide a display case which would secure the merchandise from possible theft without requiring the removal of the merchandise after business hours.

Numerous inventors have addressed the problem outlined above. For example, U.S. Pat. No. 5,733,021 and U.S. Pat. No. 5,791,749 disclose variations of a theft resistant display case, which uses an electric scissor lift mechanism to raise and lower a display platform between an upper display portion of the showcase and a lower storage portion. After the display platform is lowered into the storage portion, a multipiece closure may be interposed between the upper portion and the lower portion to enclose the merchandise in the lower storage portion, where it is more secure from theft. U.S. Pat. No. 5,853,235 discloses a burglar proof jewelry case having an upper and lower portion separated by a hinged display shelf. When a solenoid is energized, (e.g., in association with a burglar alarm), the shelf swings downward and any jewelry sitting on the shelf falls into the lower chamber where it becomes unreachable by a thief. While these and other devices have addressed some of the problems associated with the secure storage of jewelry and other valuables, many problems remain to be solved. For example, the actuating mechanisms of these devices, e.g., the electric scissor lift, tend to be overly complex, expensive and prone to failure. Further, these devices typically require electricity from wall outlets for the actuation of the various mechanisms, which can detrimentally affect cost and reliability. In many cases, the closures used to separate the display portion of the case from the storage portion of the case may be a heavy, complex device having tens or hundreds of components which greatly increases its manufacturing cost. Further, these closures may be too heavy for the average sales person to operate such that electrical power is needed to move the closure as well as to operate the display platform. A need therefor exists for display case security apparatus which overcomes the obstacles or shortcomings of the prior art.

It is desirable for a security display case to include additional storage space (i.e., besides the display section and secure storage section) for storing stocks of merchandise that are not being displayed, or to store boxes, display fixtures, supplies and the like. Such additional storage should be readily accessible from the exterior of the security case, and preferably include one or more drawers. Prior art security display cases have little, if any, additional storage space because the elevating mechanisms typically occupy or "sweep" (i.e., move or extend through) a large part of the interior of the housing. A need therefor exists for display case security apparatus which overcomes these further shortcomings of the prior art.

It is further desirable for security display cases to operate reliably and with little maintenance. Prior art security display cases often utilize elevating mechanisms that have pivoted connections to the platform and/or exert lateral forces on the platform during operation. These pivoting connections and lateral forces can cause the platform to bind within the housing during the raising and lowering operations. Uneven loading of the platform often increases the tendency for binding. This binding may result in jamming, overheating, and excessive wear on the elevating mechanism, thus increasing the need for maintenance. A need therefor exists for display case security apparatus which overcomes these still further shortcomings of the prior art.

SUMMARY OF THE INVENTION

The present invention disclosed and claimed herein comprises, in one aspect thereof, a display case security apparatus comprising a housing, a platform, an elevating mechanism, and a closure. The housing includes a lower storage section and an upper display section disposed above the storage section. The storage section has an opaque exterior wall and the display section has an exterior wall that is at least partially transparent. The platform is disposed within the housing and includes a generally horizontal portion for supporting articles to be displayed. The platform is selectively movable in the vertical direction between a first position, wherein any articles supported on the platform are in the display section of the housing, and a second position, wherein any articles supported on the platform are in the storage section of the housing. The elevating mechanism is mounted within the housing and includes a linear actuator that is selectively extendable along a straight line axis between a retracted position and an extended position. The linear actuator is connected between the housing and the platform and is positioned so that the straight line axis is oriented vertically. The platform moves between the first position and the second position when the linear actuator moves between the extended position and the retracted position, respectively. The closure is selectively interposed between the display section and the storage section when the platform is in the second position, enclosing the platform and any articles supported thereon within the storage section of the housing.

The present invention disclosed and claimed herein comprises, in another aspect thereof, a display case security apparatus comprising a housing, a platform, at least one linear actuator, and a closure. The housing includes a storage section and a display section disposed adjacent the storage section, the display section having an exterior wall that is at least partially transparent. The platform is disposed within the housing for supporting articles to be displayed. The platform is selectively movable along an axis of movement between a first position, wherein any articles supported on the platform are positioned in the display section of the housing, and a second position, wherein any articles supported on the platform are positioned in the storage section of the housing. The linear actuator is selectively extendable along a straight line axis between a retracted position and an extended position, and is connected between the housing and the platform and oriented so that the straight line axis is parallel to the axis of movement of the platform. Moving the linear actuator between the extended and retracted positions moves the platform between the first and second positions, respectively. The closure may be selectively interposed between the display section and the storage section when the platform is in the second position, whereby the platform and any articles supported thereon are enclosed within the storage section of the housing.

The present invention disclosed and claimed herein comprises, in still another aspect thereof, a display case security apparatus comprising a housing, a platform, an elevating mechanism including a linear actuator, a closure, an external drawer section and at least one storage drawer. The housing has a front side and a rear side and includes a storage section and a display section. The display section is disposed in a first direction relative to the storage section and has an exterior wall that is at least partially transparent. The platform is disposed within the housing for supporting articles to be displayed, and is selectively movable between a first position, wherein any articles supported on the platform are in the display section of the housing, and a second position, wherein any articles supported on the platform are in the storage section of the housing. The elevating mechanism is mounted within the housing and connected between the housing and the platform. The elevating mechanism includes a linear actuator that is selectively movable between an extended configuration and a retracted configuration. The platform moves between the first position and the second position when the elevating mechanism moves between the extended configuration and the retracted configuration, respectively. The closure is selectively interposed between the display section and the storage section when the platform is in the second position, whereby the platform and any articles supported thereon are enclosed within the storage section of the housing. The external drawer section is disposed in a second direction relative to the storage section, the second direction being opposite the first direction. The external drawer section is isolated from the storage section and is accessible from the exterior of the housing regardless of the position of the platform. The storage drawer is slidably mounted in the external drawer section and is accessible from the rear side of the housing.

BRIEF DESCRIPTION OF THE DRAWINGS

For a more complete understanding of the present invention and the advantages thereof, reference is now made to the following description taken in conjunction with the accompanying Drawings in which:

FIG. 1 illustrates a front perspective view of the apparatus;

FIG. 2 illustrates a rear elevation view;

FIG. 3 illustrates a cross-sectional side elevation view;

FIG. 4 is a front perspective view;

FIG. 5 is a rear elevation view with portions of the rear wall broken away to show interior details of the storage section;

FIG. 6 is a cross-sectional side elevation view;

FIG. 10 is a rear elevation view;

FIG. 11 is a front elevation view;

FIG. 12 is a cross-sectional front view with the platform in the raised position;

FIG. 13 is a cross-sectional side elevation view with the platform in the raised position;

FIG. 14 is a cross-sectional side view with the platform in the lowered position;

FIG. 15 is a cross-sectional side elevation view with the platform in the lowered position;

FIG. 16 is a rear elevation view;

FIG. 17 is a front elevation view;

FIG. 18 is a cross-sectional front view with the platform in the raised position;

FIG. 19 is a cross-sectional side elevation view with the platform in the raised position;

FIG. 20 is a cross-sectional front view with the platform in the lowered position;

FIG. 21 is a cross-sectional side elevation view with the platform in the down position;

FIG. 23 is a cross-sectional side view;

FIG. 24 is a partial cut-away rear view;

FIG. 31 is a cross-sectional side view; and

FIG. 32 is a partial cut-away rear view.

DETAILED DESCRIPTION OF THE INVENTION

Figure 1:
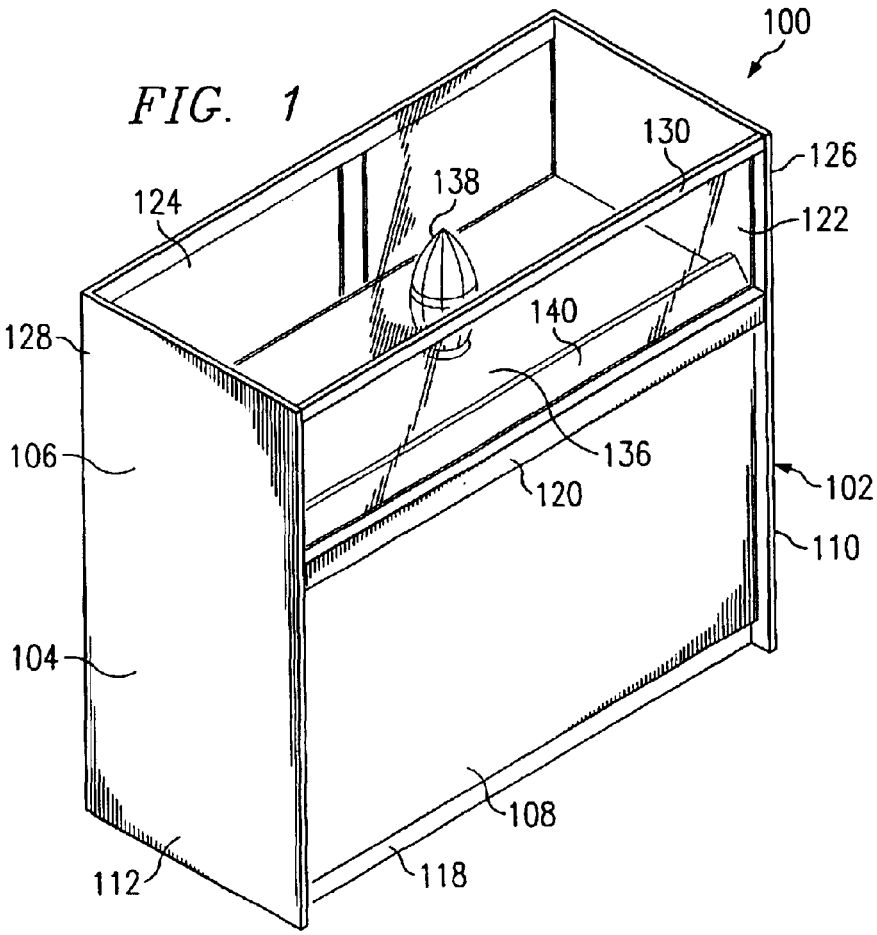
FIGS. 1–3 illustrate one embodiment of a display case security apparatus wherein the platform is in the raised position. Specifically.
Figure 2:
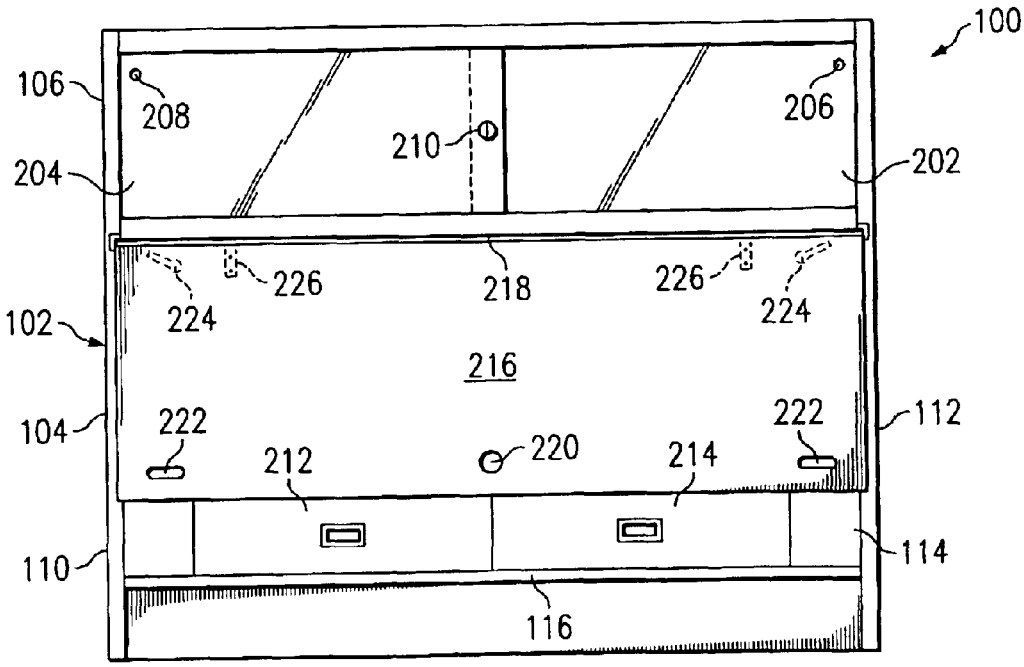
Figure 6:
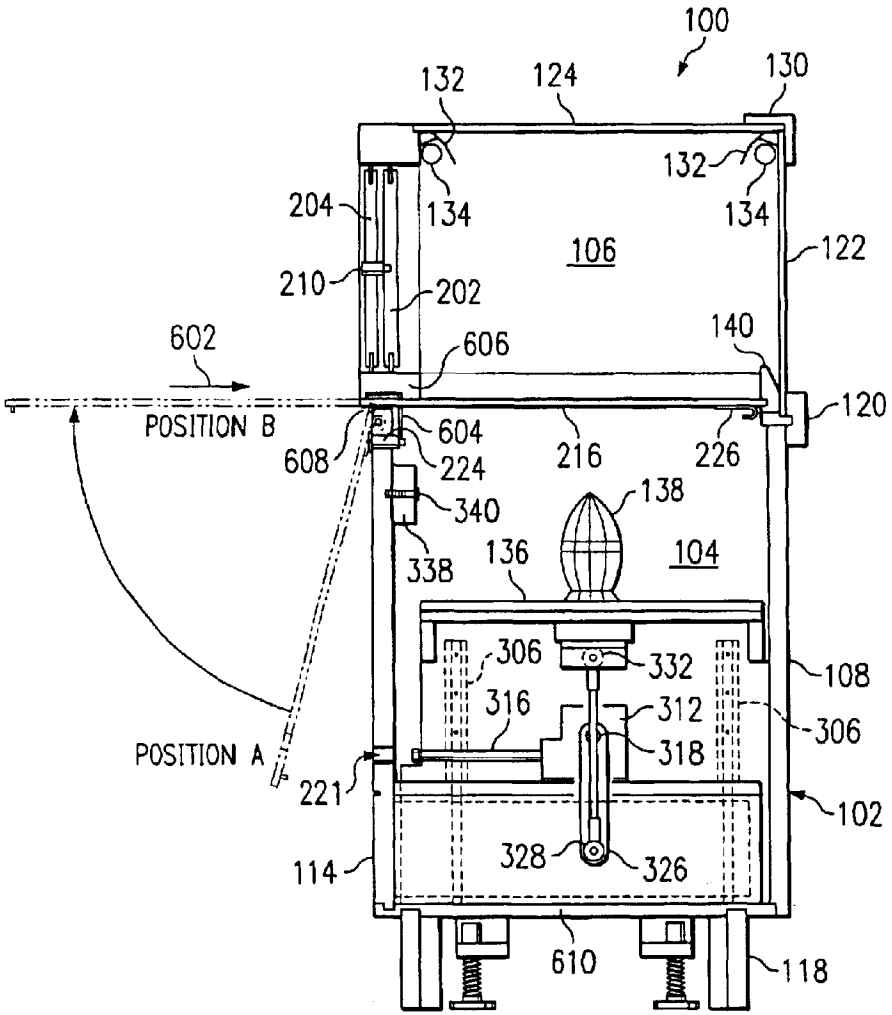
FIGS. 4–6 illustrate the display case security apparatus of FIG. 1 wherein the platform is in the lowered position. Specifically.
Figure 3:
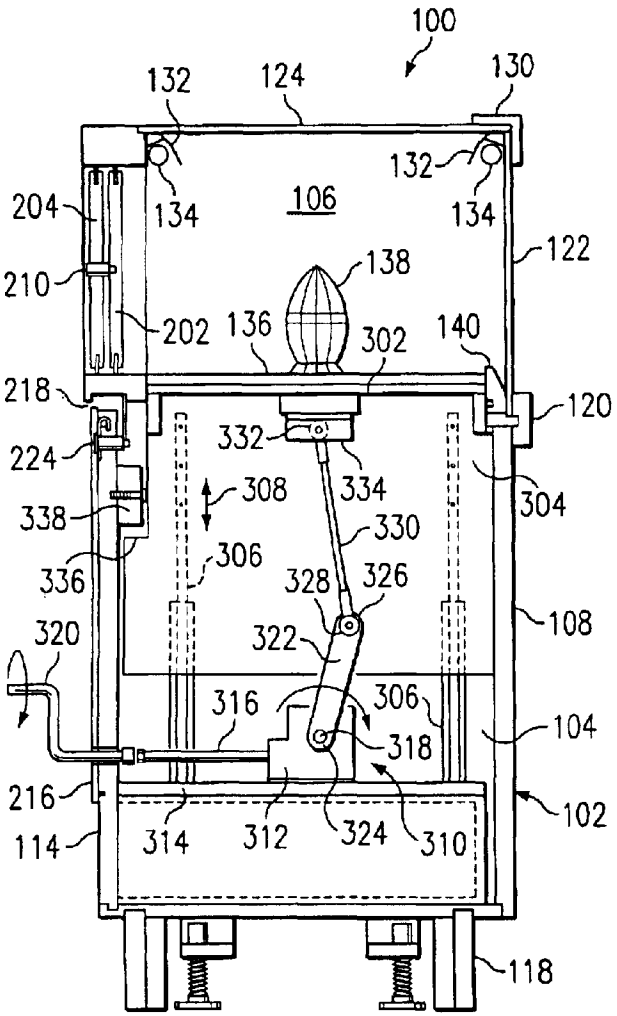
Figure 4:
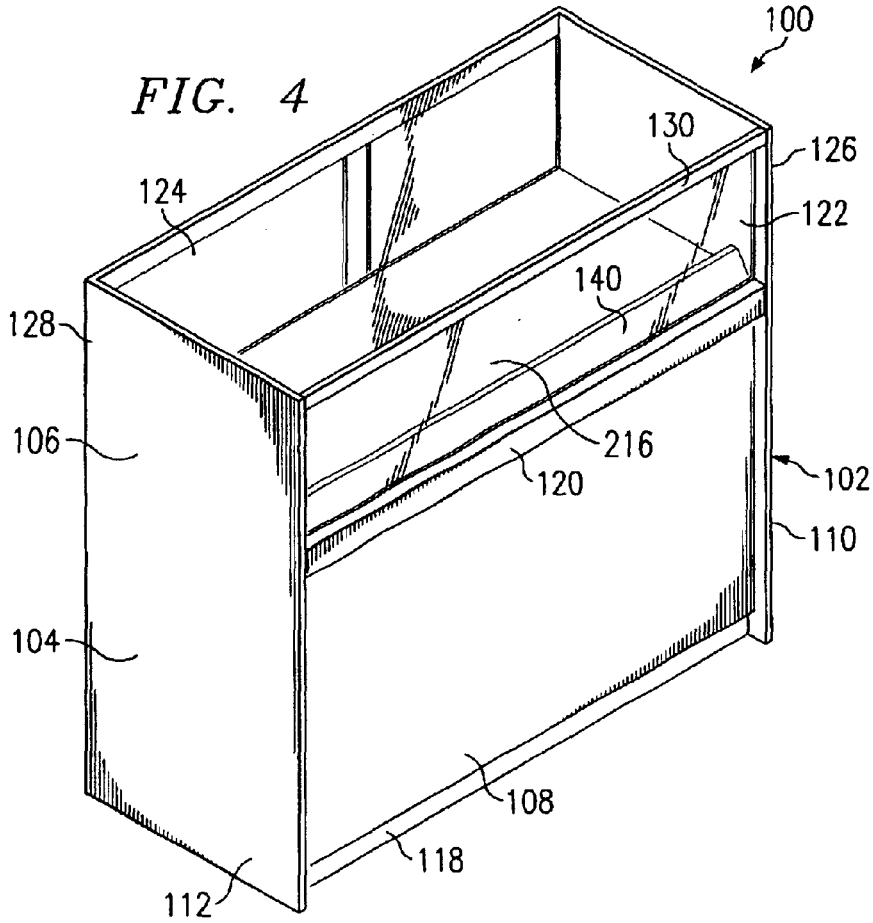
Figure 5:
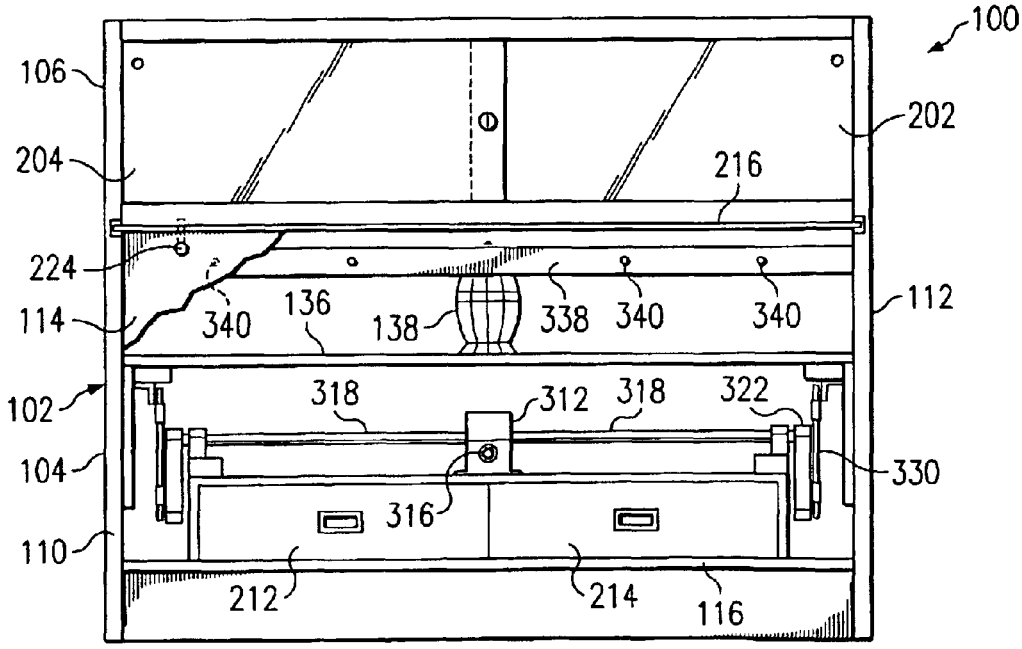

Referring now generally to FIGS. 1–6, there is illustrated one embodiment of a display case security apparatus in accordance with the current invention. In FIGS. 1–3, the apparatus is illustrated with the movable platform in the raised position. In FIGS. 4–6, the apparatus is illustrated with the platform in the lowered position. The display case security apparatus 100 comprises a housing 102 including a lower storage section 104 and an upper display section 106. The lower storage section 104 is defined by four interconnected exterior walls 108, 110, 112, and 114 that form the front, sides and rear of the storage section, respectively. The exterior walls surround a floor 116 (FIG. 2) that is disposed above a base 118. In the embodiment shown, the upper edge of the lower section 104 mounts a trim rail 120 that extends across the front of the display case and finds the lower boundary of the display section 106.

Referring specifically to FIG. 1, the exterior walls 108, 110, 112 and 114 that form the storage section 104 are typically constructed of a suitable wood, wood laminate (e.g., plywood), or wood composite (e.g., particle board) material. In some embodiments, fiberglass, metal or composite combinations of these materials may be used for the walls of the storage compartment. Regardless of the material used, the walls of the lower section should be opaque so that any articles stored in the storage section 104 will be hidden from view.

The display section 106 is generally constructed in accordance with conventional display case construction practices. Accordingly, the display section 106 has exterior walls which are at least partially transparent. It will be understood that in this context, a wall which is at least partially transparent means that at least a portion of the wall is entirely transparent. Typically, the front wall 122 and the top wall 124 will be entirely transparent, constructed of tempered or laminated glass. Alternatively, Lexan or other break resistant plastic materials may be used. The remaining walls of the display section 106 may be either fully transparent, partially transparent, or opaque, as desired. In the embodiment shown, the upper side walls 126 and 128 are unitarily formed with the corresponding lower side wall 110 and 112 respectively. The walls of the display section 106 may be joined together by frame members in a conventional manner. In the embodiment illustrated, a metal frame member 130 is provided to join the front wall 122 and the top wall 124. A light reflector 132 and light 134 may be inconspicuously positioned behind the frame member 130 in order to provide illumination for the inside of the display case.

As best seen in FIG. 2, access into the display section 106 may be provided through one or more display doors formed in the rear of the case. In the embodiment shown, two sliding doors 202, 204 are provided. A pair of finger pulls 206, 208 are provided on the rear surface of the door to facilitate their operation and a conventional cylinder lock 210 is provided for securing the doors in the locked position. It will of course be appreciated that the lock 210 provides only conventional security for the goods within the display case, i.e., they are still susceptible to a "smash and grab" type theft. The primary security of the apparatus 100 lies in the improved movable platform mechanism as described further below.

A platform 136 is disposed within the housing. The platform 136 includes a generally horizontal portion 302 for supporting articles to be displayed, e.g., article 138. The platform 136 is selectively movable within the housing 102 as will be further described below. When in the raised position, i.e., as shown FIG. 1, the platform 136 forms the apparent floor of the upper display section 106. A sign shelf 140 may also be provided within the upper display section 106. The sign shelf 140 typically slants rearwardly into the interior of the display section to conveniently support manufacturer's logos, price information, sample products, and/or similar advertising/promotional materials. It will be appreciated that the sign shelf 140 is fixed to the interior of the housing 102 and does not move with the platform 136.

One or more convenience drawers may be provided in the lower portion of the display case housing 102. In the embodiment shown, two convenience drawers 212, 214 are provided. It will be noted that the convenience drawers do not constitute a portion of the lower storage section 104, because they are accessible from the exterior of the housing 102. Instead, these drawers merely provide additional storage space for extra stock or items which would not normally be stored within the display case. As will be shown and described in further detail below, the housing 314 for the convenience drawers 212, 214 actually forms a portion of the floor of the lower storage section 104.

A closure plate 216 may be stored against the rear wall 114 of the housing. In the embodiment shown, the closure plate 216 comprises a one-piece sheet of aluminum which can be inserted into the closure slot 218 extending across the back of the housing 102. An elevating mechanisms aperture 220 is provided on the closure plate 216 which, in cooperation with a corresponding rear wall aperture 221 (FIG. 6) formed in the rear wall 114, allows access to the elevating mechanism 310 housed within the lower storage section 104. Locking slots 222 are also formed through the closure plate 216. The locking slots 222 are engaged by cam locks 224 (shown in phantom) which are mounted in the rear wall 114 of the case. The cam locks 224 are exposed for use when the closure plate 216 has been inserted into the closure slot 218 (as best seen in FIG. 4). One or more hinges 226 may be provided on the closure plate 216 to facilitate its storage on the rear of the case 102 and to further facilitate the correct positioning of the plate prior to its insertion into the closure slot 218.

Referring now specifically to FIG. 3, the interior components and operating mechanisms of the display case security apparatus 100 will be further described. As previously described, the platform 136 includes a generally horizontal portion 302 for supporting articles, e.g., article 138. In this embodiment, the platform 136 further includes end members 304 having a generally vertical orientation. A plurality of platform guide tracks 306 are attached to the interior walls of the housing 102. In the embodiment shown, the guide tracks 306 comprise a ball-bearing equipped track of the type commonly used for guiding drawers (also known as a drawer "glide"). The purpose of the platform guide tracks 306 is to interfit or cooperate with the platform 136 so as to constrain movement of the platform to a vertical translation only. In other words, the guide tracks 306 ensure that the platform 136 can translate vertically (in the direction indicated by arrow 308) while maintaining its orientation. Thus, the generally horizontal portion 302 of the platform 136 will maintain its generally horizontal orientation independent of the vertical movement of the platform.

The platform 136 is thus selectively movable between a first position (i.e., that shown in FIGS. 1–3) wherein any articles supported on the platform are displayed in the display section 106 of the housing, and a second position (i.e., that shown in FIGS. 4–6) wherein any article supported on the platform are stored in the storage section 104 of the housing. A lift or elevating mechanism 310 is mounted within the storage section and connected to the platform 136.

Figure 7:
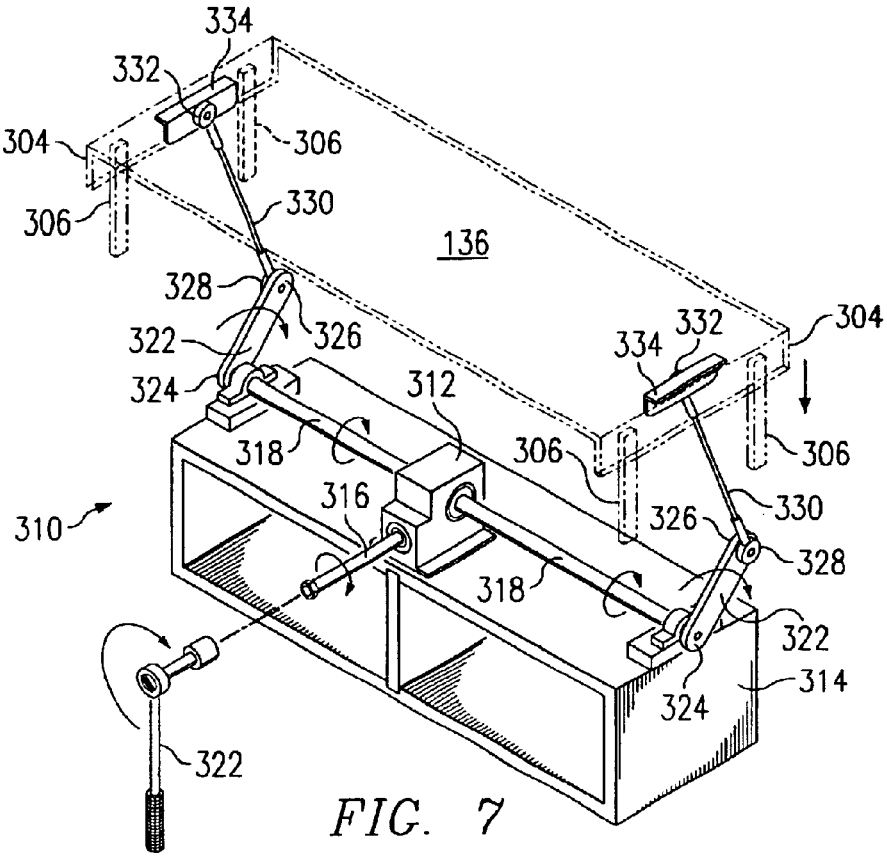
FIG. 7 is a perspective diagram illustrating one embodiment of an elevating mechanism suitable for use in the apparatus.
Figure 10:
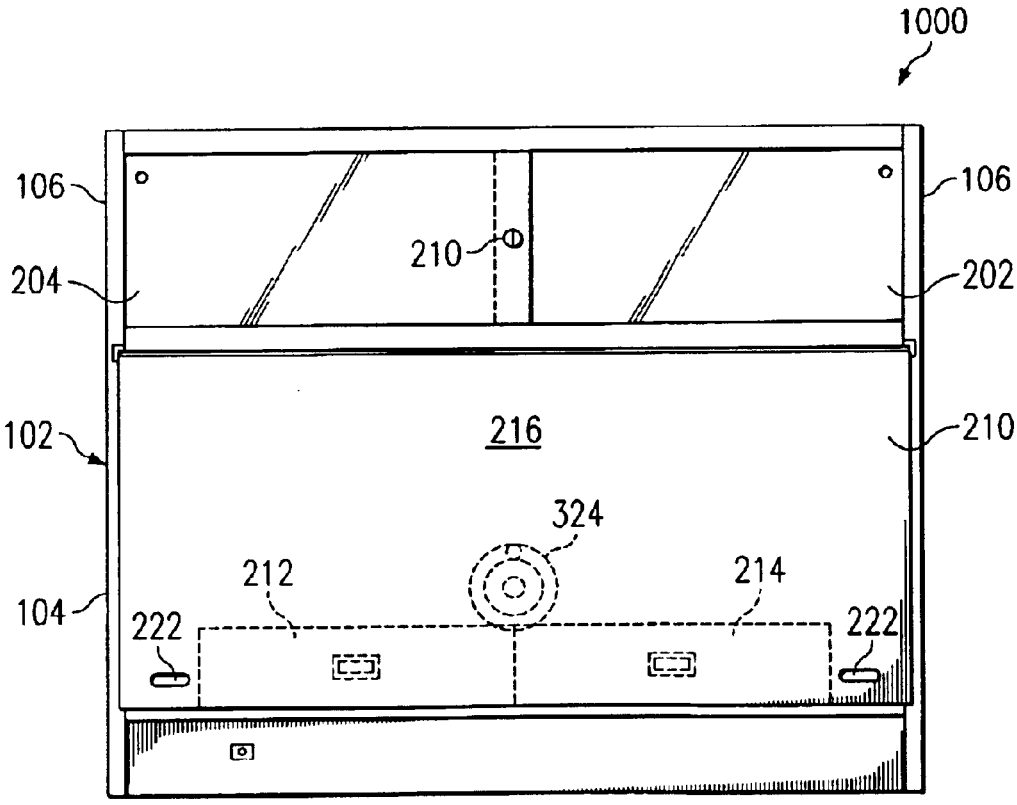
FIGS. 10–15 illustrate another embodiment of the display case security apparatus. Specifically.
Figure 11:
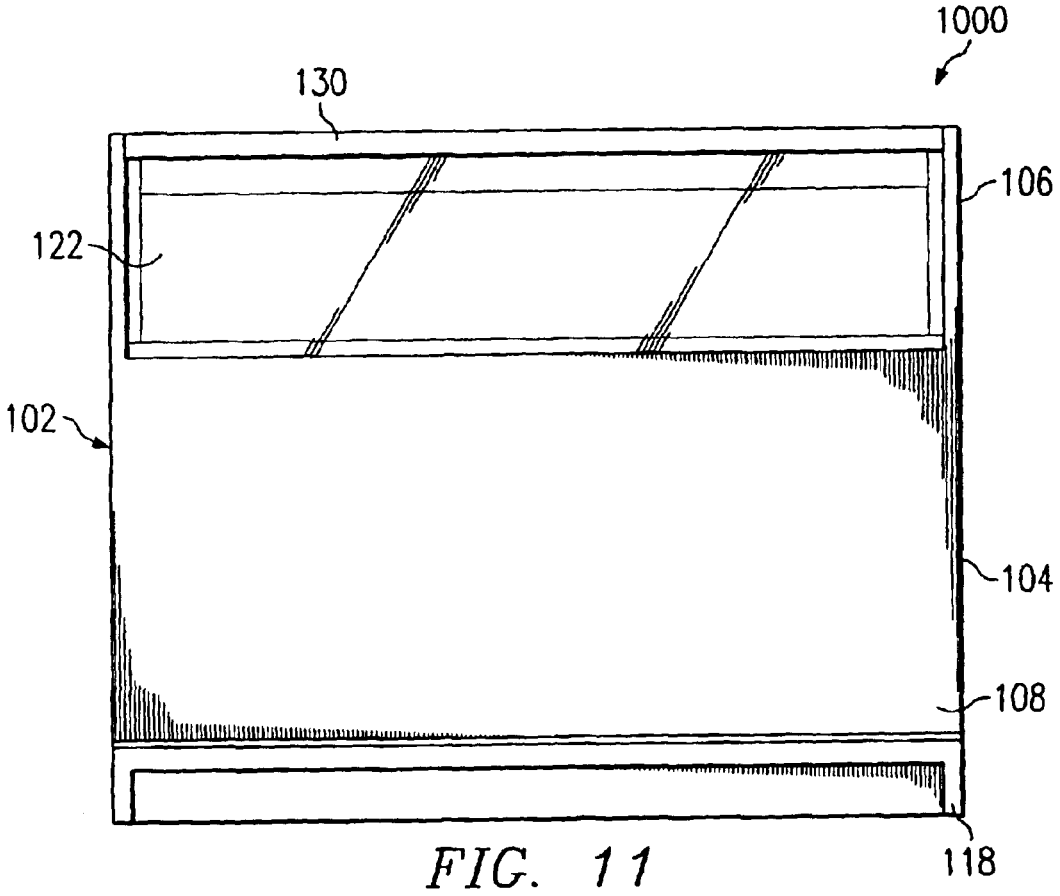
Figure 13:
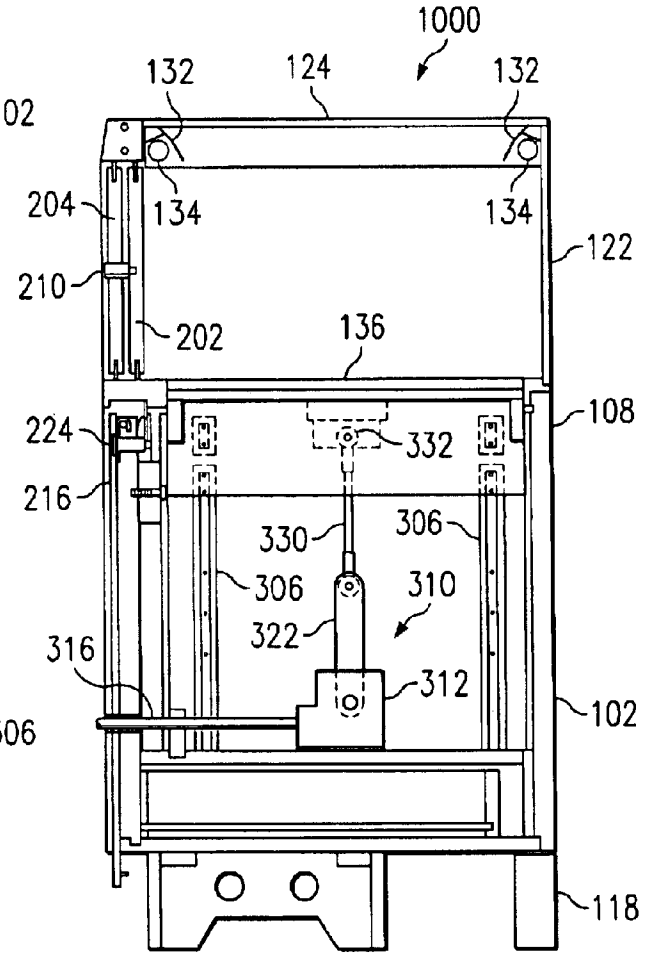
Figure 12:
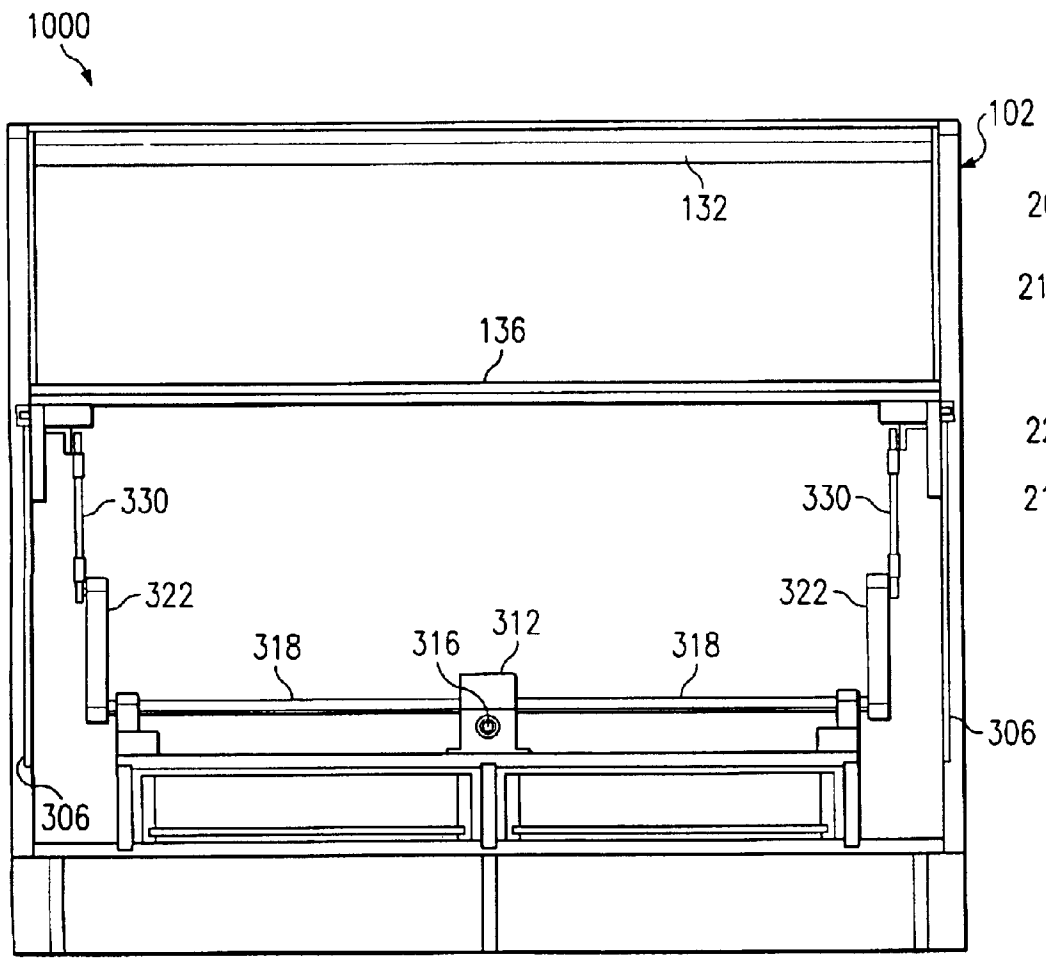
Figure 15:
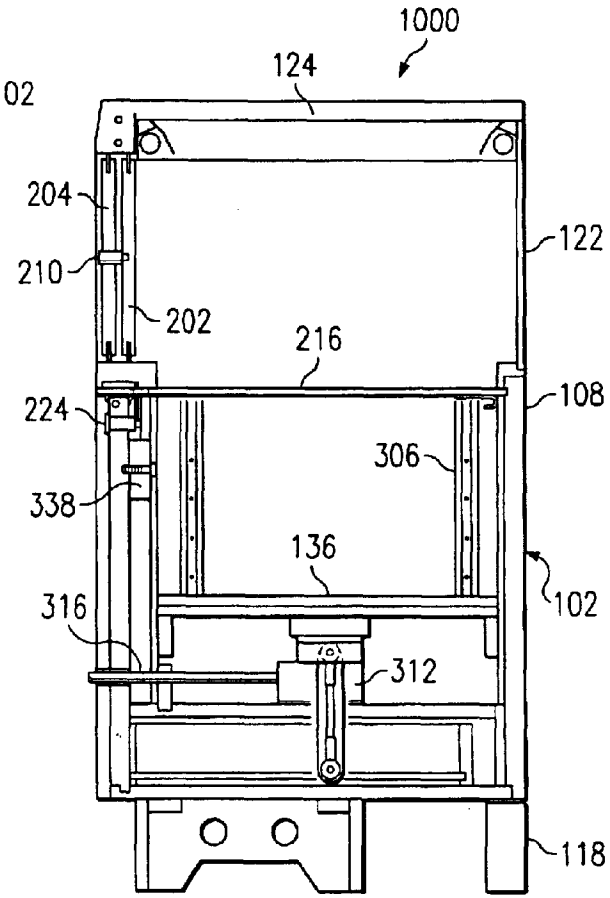
Figure 14:
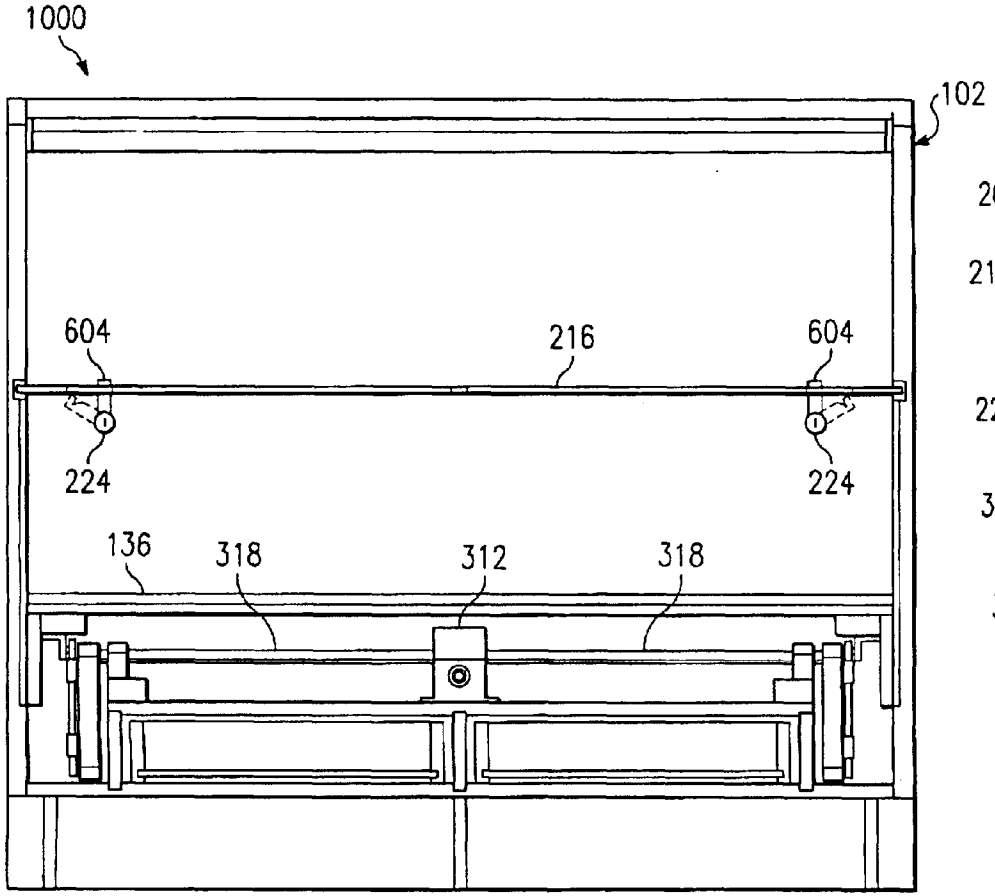
Figure 16:
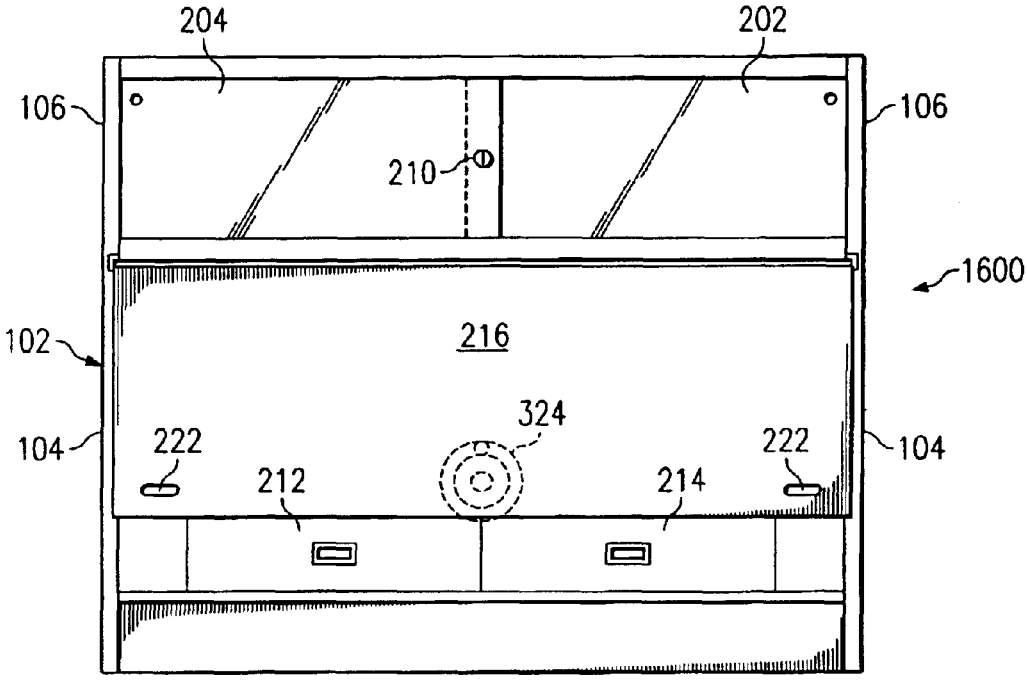
FIGS. 16–21 illustrate yet another embodiment of a display case security apparatus. Specifically.
Figure 17:
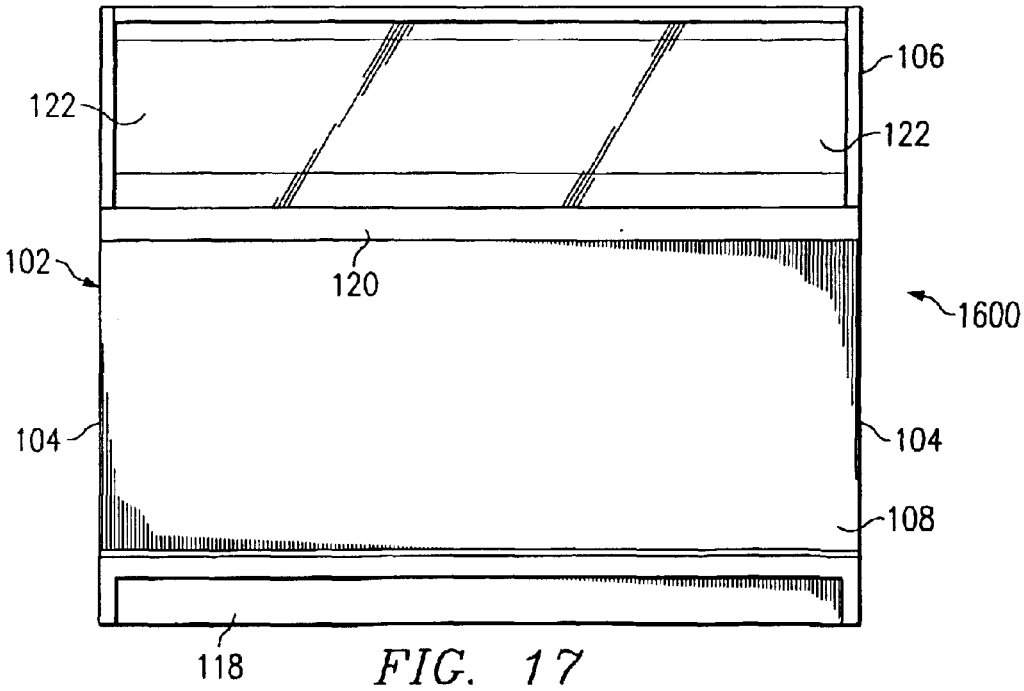
Figure 19:
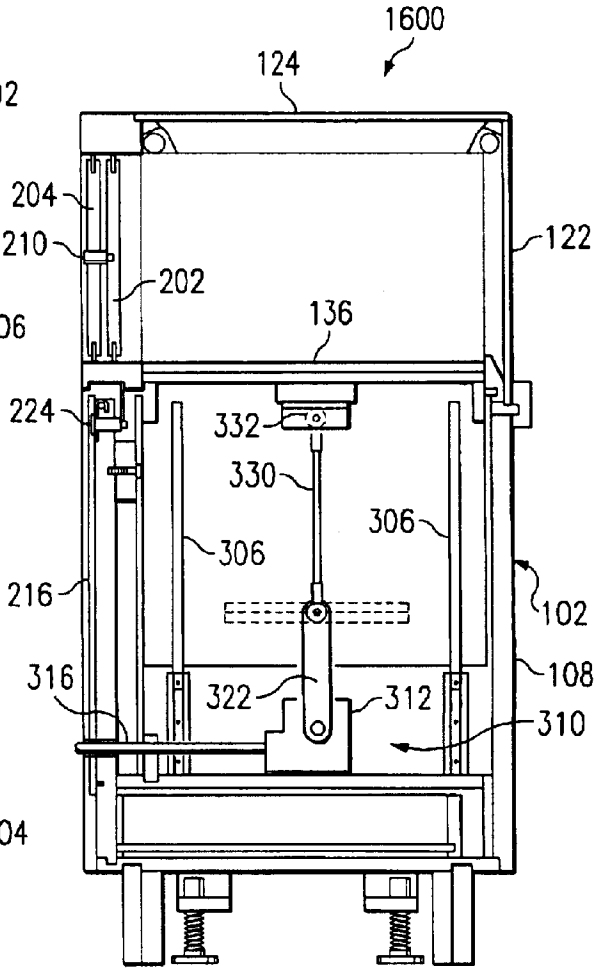
Figure 18:
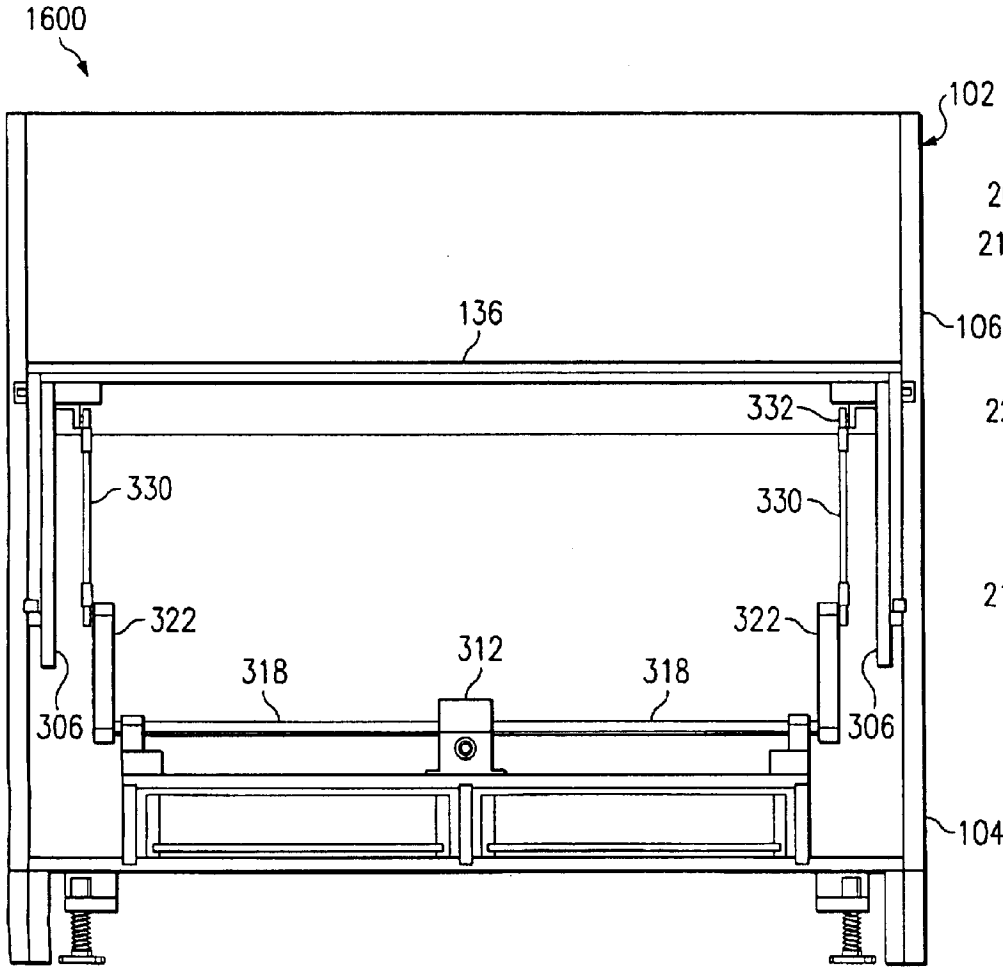
Figure 21:
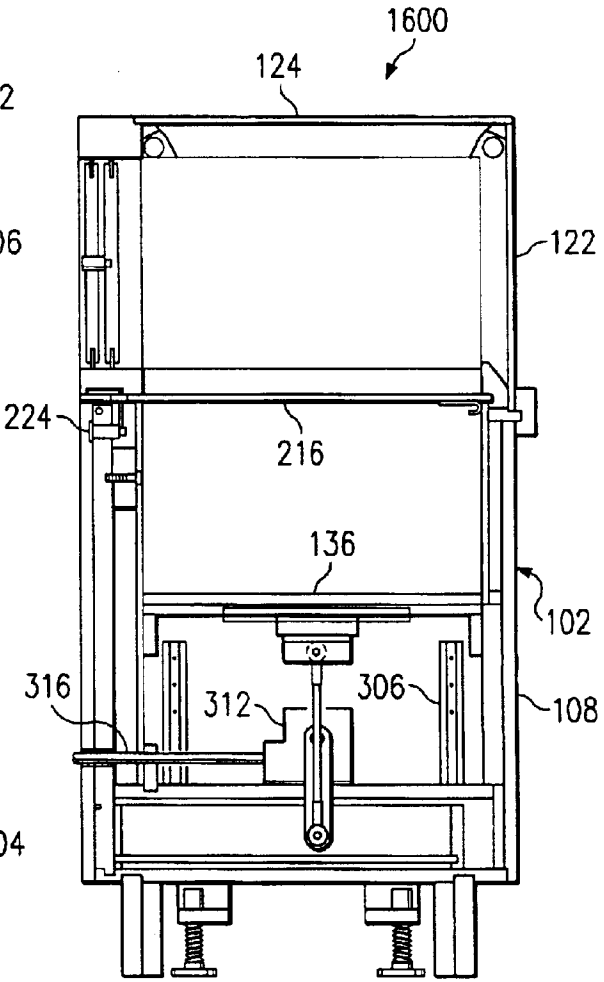
Figure 20:
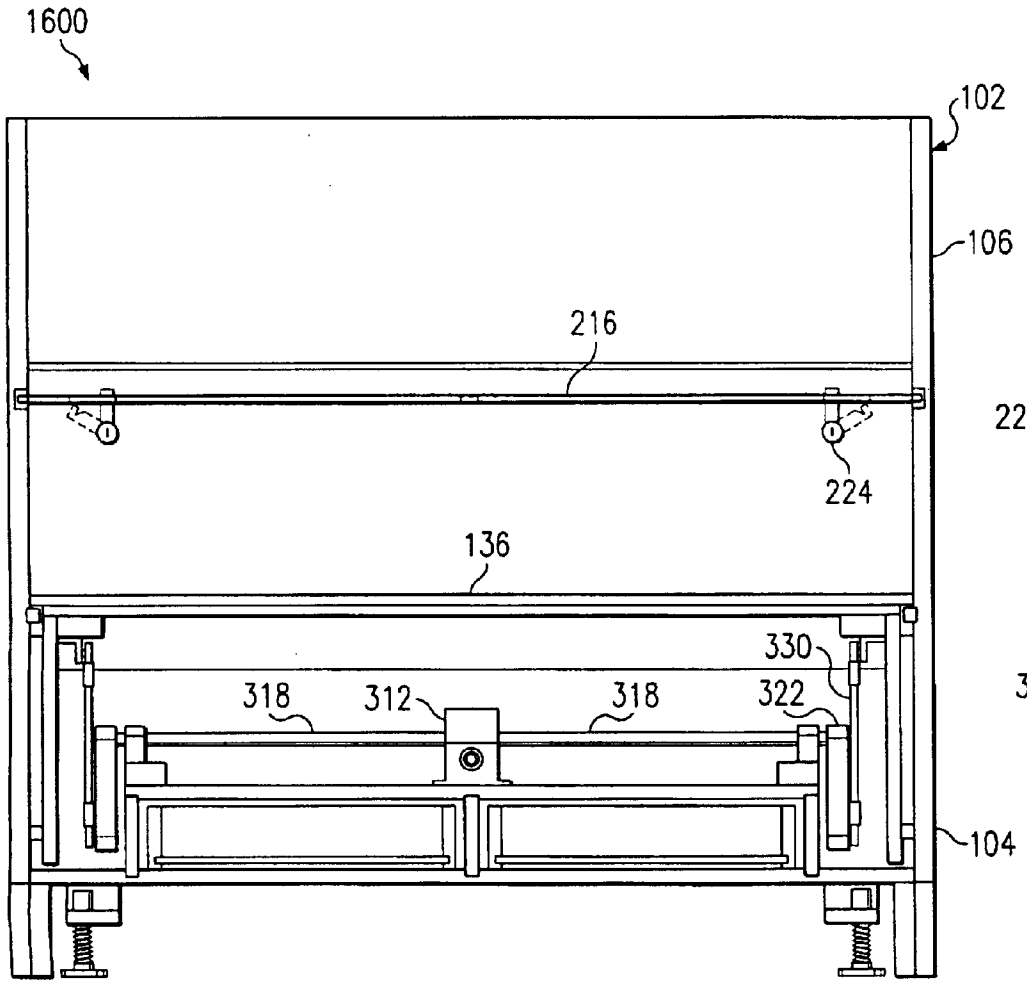

A reduction gear box 312 is mounted on the housing 314 for the convenience drawers 212, 214. An input shaft 316 engages the input portion of the reduction gear box 312 and one or more crankshafts 318 engage the output portion of the reduction gear box. As with any reduction gear box, a first number of rotations of the input shaft 316 will produce a second number of rotations of the crankshaft 318 where the first and second number constitute a predetermined ratio. In the display case security apparatus 100, it has been found that comfortable and convenient manual operation of the elevating mechanism can be obtained with a reduction gear box 312 having a ratio within the range from about 40:1 to about 80:1. In a more preferred embodiment, the predetermined ratio is within the range from about 50:1 to about 70:1. It will be appreciated that the reduction gear box 312 in the illustrated embodiment is a "right angle" drive, i.e., the axis of the input shaft 316 and the axis of the crankshaft 318 lie in planes which form an angle of about 90° to one another. This provides for the convenient orientation of the input shaft 316 near the rear wall of the case 102 such that an actuating device, e.g., a crank 320, a ratchet 322 (e.g., as shown in FIG. 7) or a wheel 324 (e.g., as shown in FIG. 10) can be inserted from the rear of the case to manually actuate the elevating mechanism 310.

The lift or elevating mechanism 310 further includes at least one pair of links. The first link 322 of each pair of links has a first end 324 which engages the crankshaft 318 so as to rotate with it and a second end 326 which is pivotally connected to a first end 328 of the second link 330. Each of the second links 330 has a second end 332 which is pivotally connected to the platform 136. In this case, brackets 334 are used to provide an interface between the second link 330 and the platform 136. Rotation of the crankshaft 318 moves the links 322, 330 of the elevating mechanism 310 whereby the platform 136 moves along the platform guide tracks 306 in a vertical motion as shown by arrow 308. This allows the platform 136 to move between the first position (e.g., FIG. 3) and the second position (e.g., FIG. 6). When the platform is in the second position, any articles 138 on the platform will now be disposed in the storage section 104 of the case, ready to be secured by the positioning of the closure plate 216.

If it is desired to provide positive stops on the elevating mechanism, these may be provided by forming notches 336 in the side plates 304 of the platform 136. These notches 336 engage fixed members, e.g., rear cross-member 338, when the platform 136 is in the first (i.e., fully-raised) position. Similarly, stops for the downward travel of the platform 136 may be provided. In alternative embodiments, travel stops may be provided by placing blocks which limit the travel of the first link 322 and/or the second link 330 of the elevating mechanism rather than by blocking [the platform] travel of the platform 136. In yet other embodiments, the links 322 and/or 330 may be selected such that the upper travel limit is defined by the top dead center (TDC) position of the two links and the lower travel limit is defined by the bottom dead center (BDC) position of the two links. In this situation, no physical stops are required to limit the travel of the platform 136 in the upward or downward direction. Further, when utilizing the TDC/BDC principle to define the upper and lower limits of platform travel, it is possible to complete both raising and lowering actions of the platform 136 while turning the input shaft 316 in a single direction, i.e., without reversing the direction of rotation for the input shaft or the direction of rotation of the crankshaft 318. In alternative embodiments where the elevating mechanism 310 is powered using an electric motor, use of the TDC/BDC principle would allow a single direction (i.e., non-reversing) electrical motor to be used for raising and lowering the platform 136. It will be appreciated that in such cases the crankshaft 318 rotates in a single direction while the platform 136 reciprocates up and down. This eliminates the need for a reversing switch or other circuitry to reverse the direction of the input shaft's rotation in order to reverse the direction of travel of the platform as is required in other types of elevating mechanisms.

Figure 8:
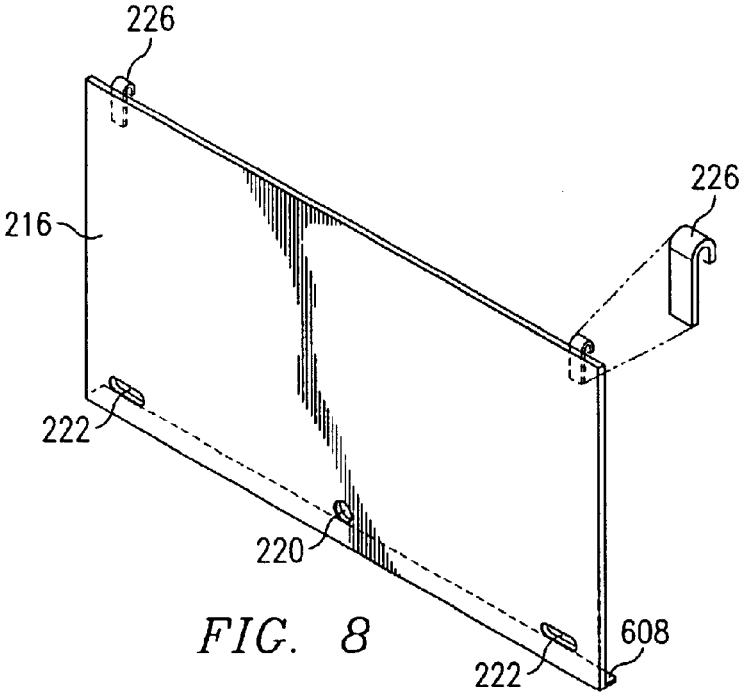
FIG. 8 is a perspective view illustrating the details of one embodiment of a closure plate including an enlarged view of the hinge.

Referring now to FIGS. 4–6, the display case security apparatus 100 is illustrated with the platform 136 in the second position, i.e., with the platform and displayed articles 138 disposed in the storage section 104 of the case 102. Once the platform has been moved into this position, the closure plate 216 maybe moved from its storage position, i.e., hanging against the back wall 114 of the case 102 and placed into the closure slot 218 between the display section 106 and the storage section 104. Referring now also to FIG. 8, there are illustrated details of the closure plate 216. In a preferred embodiment, the closure is a one-piece sheet of aluminum alloy having a generally uniform thickness within the range of about ⅛" to about ¼". A thickness of about 3/16" has proven to work well. By utilizing aluminum alloy, an extremely tough closure plate 216 is obtained, yet it is very light in weight such that the plate can be manually lifted from its rest position (FIG. 3) through the position designated "POS. A" in FIG. 6 to the generally horizontal designated position "POS. B" in FIG. 6, without putting undue strain on the salesperson performing the task. Once the closure plate 216 has been raised into the "POS. B" configuration, it is simply pushed into place in the direction of arrow 602. It will be noted that as the closure plate 216 is pushed forward, the hinge hook 226 will automatically detach from the rear wall 114 of the case and move forward with the plate. Once the plate 216 has been put in the closed position, i.e., interposed between the display section 106 and the storage section 104, the cam locks 224 mounted on the rear wall 114 of the case can be activated. The latch 604 of the cam lock 224 moves through the latching slot 222 in the closure plate 216 and engages a slot in the structural member 606 immediately above the cam lock, thus preventing withdrawal of the closure plate. It will be noted that the lip 608 on the closure plate 216 extends downwards from the plate to prevent a criminal from attempting to defeat the cam lock latch 604.

Once the platform 136 has been moved into the second position and the closure plate 216 moved into position and locked using cam locks 224, articles 138 supported on the platform are protected from "smash and grab" theft. In fact, the case 102 appears empty as illustrated by FIG. 4. The display case security apparatus 100 provides additional security features to minimize the likelihood that a thief will be able to obtain access to the storage section 104 of the case in a short period of time. One example of such enhanced security features is the fact that the exterior walls of the lower storage section 104 are secured using no externally accessible fasteners. As best seen in FIG. 5, the rear wall 114 is secured to the interior cross-member 338 using a plurality of fasteners 340, which are inserted from the interior of cross-member 338. Thus, removing the rear wall 114 (which must be provided for in case maintenance on the elevating mechanism 310 is required) requires that the closure plate 216 be withdrawn, at which point, the fasteners 340 may be withdrawn from the interior side of cross-member 338, allowing wall 314 to swing backwards and disengage the slot 610 running across the bottom of the case.

Figure 9:
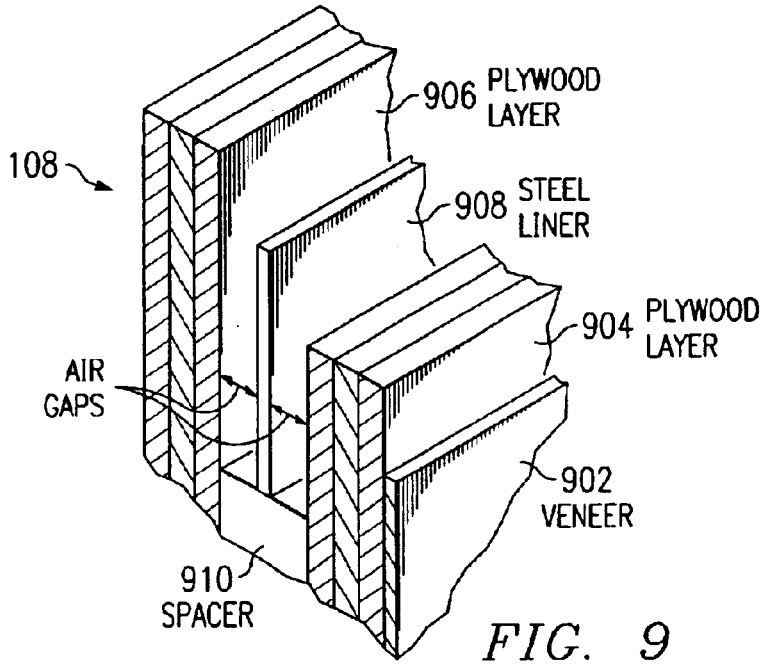
FIG. 9 is an enlarged cross-sectional perspective view of the lower storage section exterior wall.

Referring now to FIG. 9, there is illustrated an enlarged cross-sectional view of a portion of the exterior wall of the lower storage section 104, in this case a portion of the front wall 108. It is conventional to provide a shield or liner of thin metal inside the wooden cabinet. The metallic liner understood to provide additional protection against saw-through attacks against the case. In the prior art, however, the metallic liner is affixed to the interior of the wooden structure using fasteners such as rivets, bolts, nails, etc. It has now been discovered that this direct attachment of the liner to the cabinet structure actually reduces the effectiveness of the liner in preventing saw-through attacks. Thus, in the current invention, the metallic liner is not affixed to either the interior or exterior walls of the cabinet. Rather, it "floats" in a slot formed between two spaced-apart layers of cabinet material. In the example shown in FIG. 9, the exterior wall 108 comprises veneer 902 over a plywood panel 904 which is spaced-apart from an interior panel 906 which is also made of plywood. A thin metallic liner 908 is placed in the slot 910 between the two plywood layers 904, 906. The metallic liner 908 is not affixed to either layer 904 or 906, but merely rests within the slot 910 such that it may float if it is disturbed by, e.g., a reciprocating saw blade or other attack upon the cabinet. In one embodiment, the inner and outer plywood layers 906, 904 are formed of ¾" plywood material while the metallic liner 908 has a thickness of substantially less than 1/16". In another embodiment, the outer layer is made from ¾" plywood while the inner layer is made from ¼" melamine or other composite wood product. Again, a metallic liner having a thickness substantially less than 1/16" is placed in a slot formed between the two wooden layers but not firmly affixed to either layer.

Referring now to FIGS. 10–15, there is illustrated another embodiment of a display case security apparatus. The display case security apparatus 1000 has many elements which are substantially identical to those previously described for the display case security apparatus 100 (FIGS. 1–9). These elements are therefore denoted using the same reference numbers.

Referring now to FIGS. 16–21, there is illustrated another embodiment of a display case security apparatus. The display case security apparatus 1600 has many elements which are substantially identical to those previously described for the display case security apparatus 100, 1000. These elements are therefore denoted using the same reference numbers.

Figure 22:
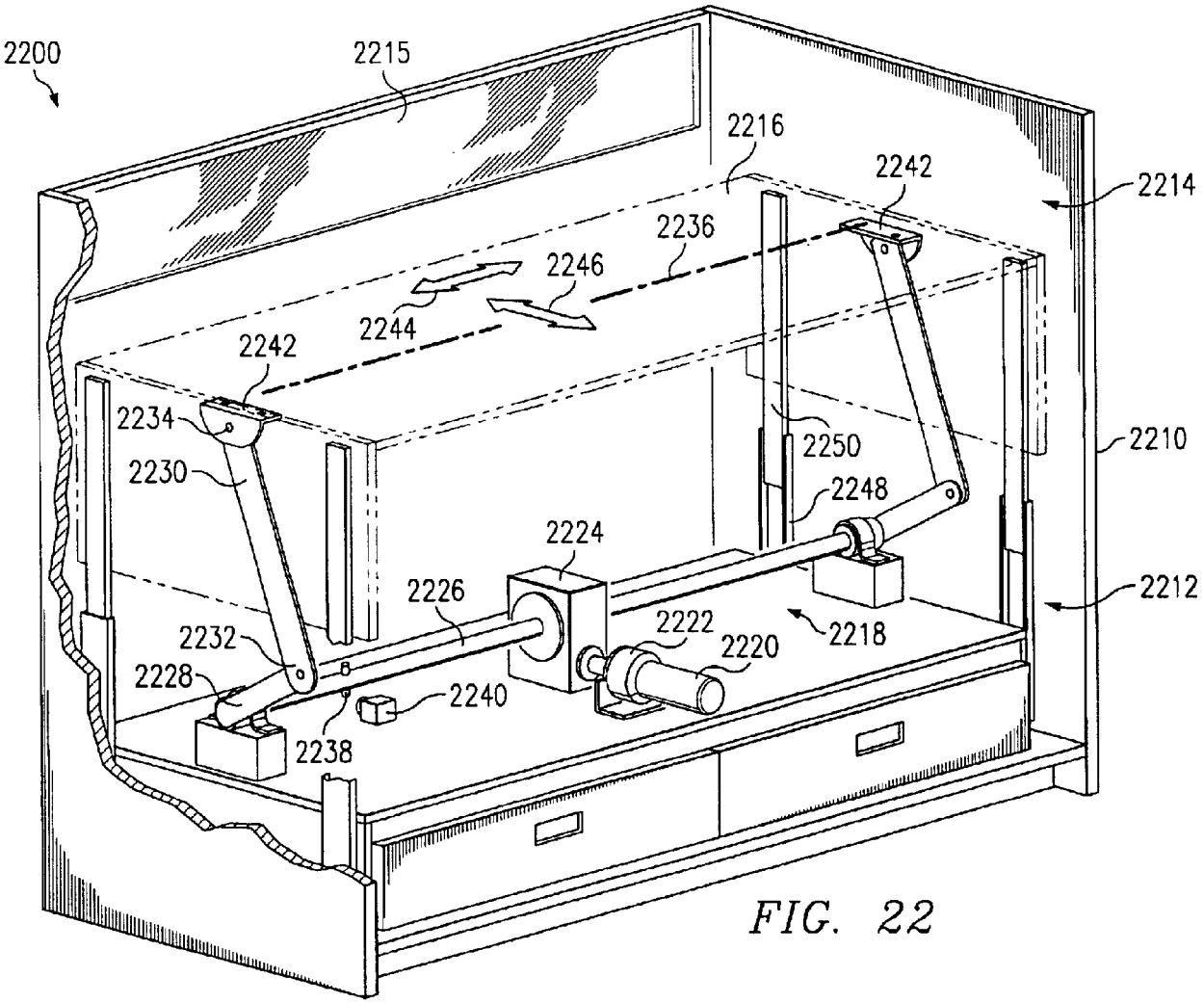
FIG. 22 is a rear perspective view of an yet another embodiment of a display case security apparatus with portions broken away for purposes of illustration.

Referring now to FIG. 22, there is illustrated yet another embodiment of a display case security apparatus, this embodiment incorporating an electrically powered lift mechanism. The display case security apparatus 2200 includes a housing 2210 including a lower storage section 2212 and an upper display section 2214 with transparent display window 2215. A movable platform 2216 (shown in broken line for purposes of illustration) is mounted in the housing using guides or slides 2248, 2250 which constrain the movement of the platform to vertical, i.e., up-and-down, motion only. The apparatus 2200 further includes an electrical elevating mechanism 2218 with an electric motor 2220 ("the Drive Motor") having an output shaft (not shown) that always rotates in the same direction (i.e., it does not reverse direction) during operation. The output shaft of the Drive Motor 2220 is connected to an in-line reduction gear mechanism 2222 ("the Primary Reducer"), which, in turn is connected to a right-angle reduction gear mechanism 2224 ("the Secondary Reducer") such that when the Drive Motor is operated, the output of the Secondary Reducer always rotates in the same direction. The output of the Secondary Reducer 2224 is connected to a crankshaft 2226, which, in turn has a crank arm 2228 connected to each end such that when Drive Motor 2220 is operated, the crankshaft 2226 rotates and the outer end of each crank arm 2228 revolves in a circle, always in the same direction. A connecting arm 2230 is pivotally connected between the outer end of each crank arm 2228 (at the point designated 2232) and the respective underside end of the movable platform 2216 (at the point designated 2234) to allow relative angular movement, but no sliding movement, between the respective components. When the Drive Motor 2220 operates, the lower end of each connecting arm 2230 revolves in a circle around the crankshaft (always in the same direction), thereby causing the upper ends of the connecting arms (which are attached to the platform 2216 that is constrained to move in the vertical direction only) to reciprocate, i.e., to move alternately up and down. The platform 2216, which is supported by the upper ends of the connecting arms 2230, is thereby alternately raised into the display section 2214 of the housing and lowered into the storage section 2212 of the housing as the Drive Motor 2220 operates in a single direction.

It will be appreciated that the elevating mechanism of this embodiment has no intrinsic stopping point while operating. Instead, as long as the Drive Motor 2220 operates (rotating in a single direction), the elevating mechanism will continuously raise and lower the platform 2216 without requiring the direction of rotation of any part of the mechanism to be reversed. Therefore, a cam member 2238 is disposed on the crankshaft 2226. The cam member 2238 cooperates with a sensor 2240, which may be a contact switch, a magnetic detector, an optical detector, or other such device, to determine the rotational position of the crankshaft 2226, and thus also the position of the platform 2216 such that the raising and lowering operation may be stopped at the desired point. It will also be appreciated that the elevating mechanism of this embodiment may be actuated to both raise and lower the platform using only a simple two-state switch (i.e., on—off). It will still further be appreciated that an electric motor of the type operated on AC electrical power or of the type operating on DC electric power may be employed for the Drive Motor 2220, depending upon the type of power available, preference of the user, or other considerations.

It will be further appreciated that the elevating mechanism of this embodiment has only two points of contact with the display platform 2216, namely at points 2242 where the connecting arms 2230 are connected to the underside of the platform along the longitudinal axis 2236 that runs in the side-to-side direction (i.e., as indicated by arrow 2244). These are insufficient, by themselves, to stabilize the platform 2216 in the front-to-back direction (indicated by arrow 2246). Consequently, the platform 2216 is stabilized in the front-to-back direction during raising and lowering by the drawer guides 2248, 2250 at each of the four corners of the platform.

Figure 23:
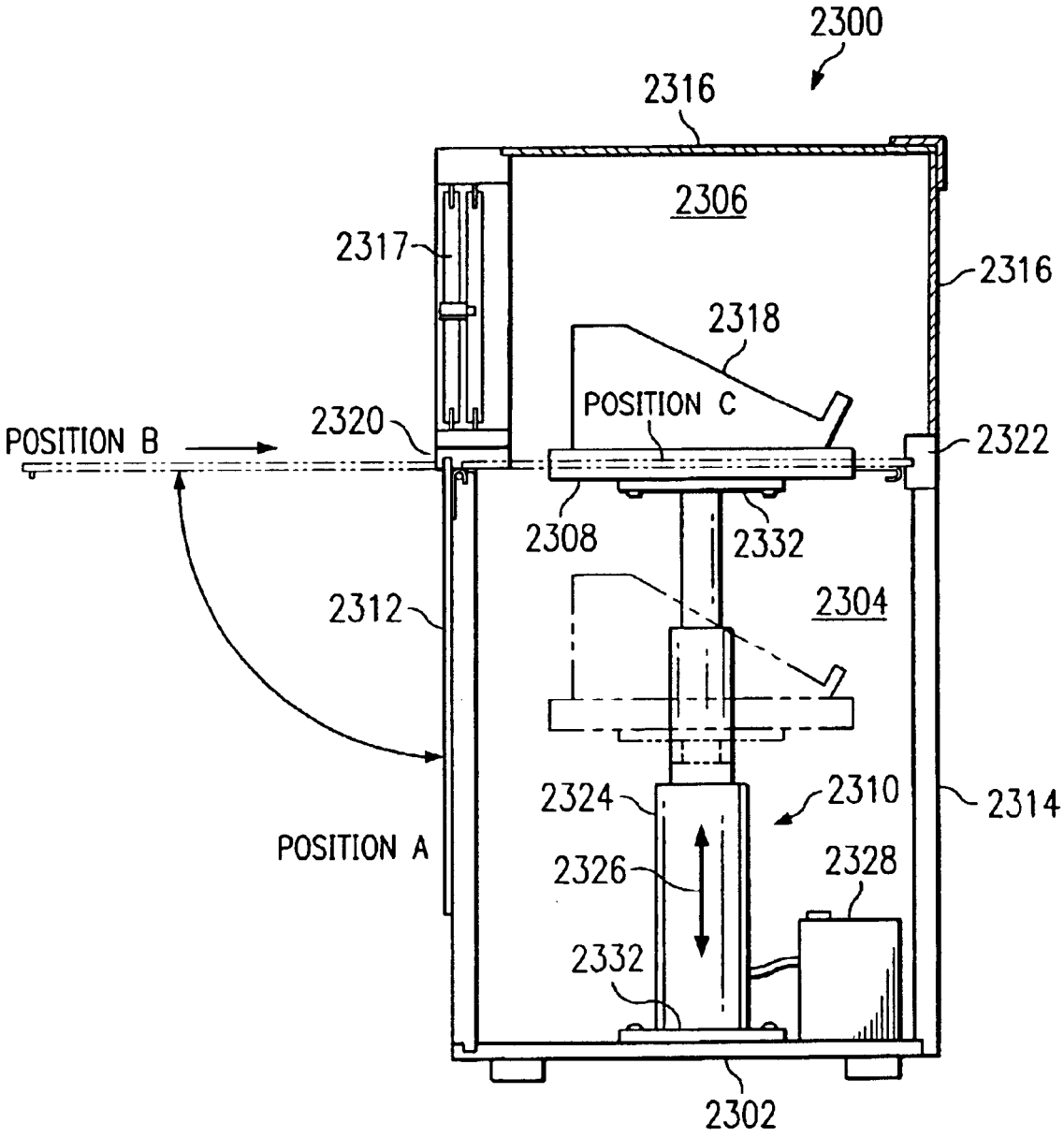
FIGS. 23–24 illustrate still another embodiment of a display case security apparatus wherein the elevating mechanism includes a linear actuator. Specifically.
Figure 24:
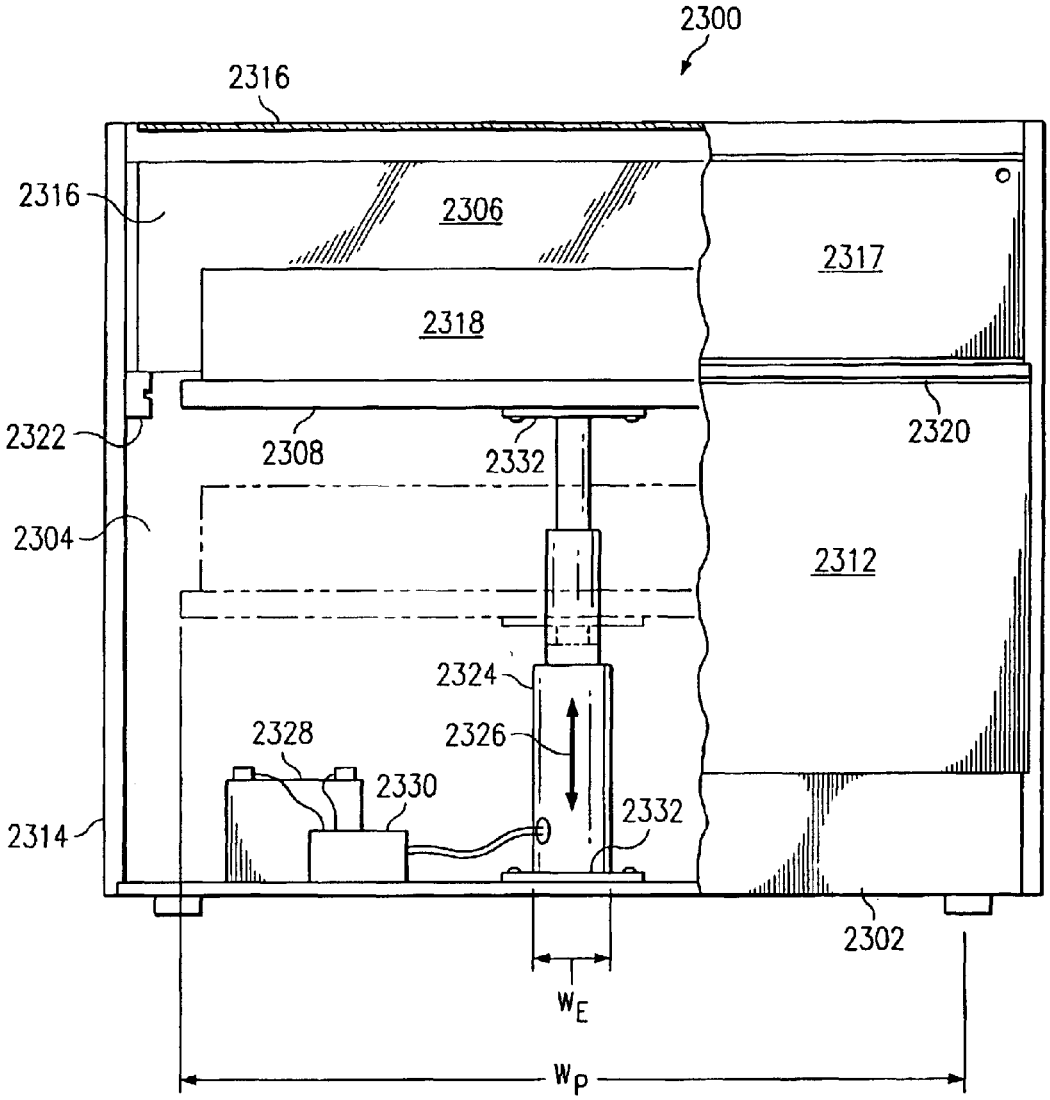

Referring now to FIGS. 23 and 24, there is illustrated yet another embodiment of a display case security apparatus. FIG. 23 shows a cross-sectional side view of the apparatus, while FIG. 24 shows a partial cut-away rear view. The apparatus 2300 has a configuration similar in many respects to the display case security apparatus previously described herein, including a housing 2302 with a storage section 2304 and a display section 2306, a movable platform 2308, an elevating mechanism 2310 and a closure 2312. The storage section 2304 has an opaque exterior wall 2314, while the display section 2306 includes at least one exterior wall that is transparent. In this case, the transparent walls are windows 2316 on the front and top of the display section. Sliding doors 2317 are provided on the upper rear side of the housing 2302 to provide access to the display section 2306. As in previous embodiments, the platform 2308 supports the articles to be displayed, and is selectively movable between a first position (shown in solid line), wherein any articles on the platform are disposed in the display section 2306, and a second position (shown in broken line), wherein the platform and any articles thereon are disposed in the storage section 2304. An optional angled fixture 2318 is provided on the platform 2308 in this embodiment to hold the articles being displayed at a preferred orientation for viewing. When the platform 2308 is in the first (i.e., display) position, the closure 2312 is typically stored vertically against the rear of the housing (POS. A in FIG. 23). When the platform 2308 is in the second (storage) position, the closure 2312 is first raised to a horizontal position (POS. B, shown in broken line) and then inserted through a slot 2320 on the rear of the housing 2302 and into guide rails 2322 so as to be interposed between the display section 2306 and the storage section 2304 (POS. C, shown in broken line). With the closure 2312 thus interposed, any articles on the platform 2308 are securely enclosed within the storage section 2304 of the apparatus.

The elevating mechanism 2310 of this embodiment includes a linear actuator 2324 that is selectively extendable along a straight line axis 2326 between a retracted configuration (shown in broken line) and an extended configuration (shown in solid line). The linear actuator 2324 is connected between the housing 2302 and the platform 2308. In this embodiment, the linear actuator 2324 is positioned so that the straight line axis 2326 is oriented vertically. Thus, the platform 2308 moves vertically between the first position and the second position when the linear actuator 2324 moves between the extended configuration and the retracted configuration, respectively.

It will be appreciated that using a linear actuator 2324 for the elevating mechanism 2310 provides a number of advantages over other types of elevating mechanisms. First, the linear actuator 2324 does not sweep laterally during it operation, but instead has a constant "footprint" along the axis of extension 2326. Put another way, a projection of the cross section of the linear actuator 2324 onto a plane perpendicular to the axis of extension 2326 does not change as the actuator extends and retracts. This makes all of the interior space laterally surrounding (i.e., to the front, back, right and left of) the elevating mechanism 2310 usable for storage or positioning of equipment such as a power source 2328 (e.g., a battery) and/or control circuitry 2330. As disclosed further herein below, in other embodiments, this free interior space may also be used for under-counter storage.

It will further be appreciated that use of linear actuators allows the elevating mechanism 2310 to be constructed with very compact lateral dimensions. As best seen in FIG. 24, the maximum lateral width of the elevating mechanism 2310 (denoted $W_E$) is much smaller than the maximum lateral width of the platform 2308 (denoted $W_P$). In a preferred embodiment, the maximum lateral width of the elevating mechanism 2310 is less than about 25% of the maximum lateral width of the platform 2308. In a more preferred embodiment, the maximum lateral width of the elevating mechanism 2310 is less than about 15% of the maximum lateral width of the platform 2308.

Further still, use of linear actuators for the elevating mechanism 2310 eliminates the need for rails to guide the platform 2308, and also for pivoting connections between the mechanism and the platform. Instead, the actuator 2324 may be rigidly attached, i.e., with screws, bolts or other fastening means, to the housing 2302 and/or to the platform 2308 using mounting plates 2332 on the ends of the actuator. It will be appreciated that the rigid attachment of the elevating mechanism 2310 to the platform 2308 allows the mechanism to resist torques and moments imposed by the platform. This prevents horizontal translation or tipping of the platform 2308, even when the platform is unevenly loaded. This rigid attachment, and the absence of any lateral forces from the linear actuator 2324, also serves to minimize binding of the platform 2308 within the housing 2302 during operation of the elevating mechanism.

Referring now to FIGS. 25–28, several alternative configurations for the security display case apparatus are illustrated. It will be appreciated that, for purposes of illustration, the rear panel of the apparatus has been removed in these views. Also, note that in each of these views the platform is shown in its retracted position (in solid line), but the extended position is also indicated using broken line.

Figure 25:
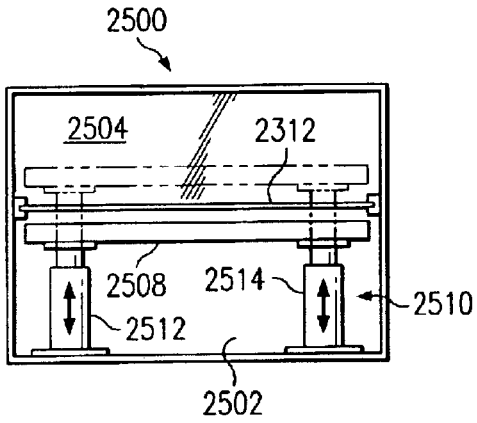
FIG. 25 is a rear elevation view, with the rear panel removed for purposes of illustration, of yet another embodiment having an elevating mechanism comprising two spaced-apart linear actuators.

FIG. 25 illustrates an apparatus 2500 with a storage section 2502 and a display section 2504 wherein the elevating mechanism 2510 comprises two linear actuators 2512 and 2514 that are spaced-apart under the platform 2508. Such a configuration could accommodate a single large storage drawer positioned between the actuators 2512 and 2514, or alternatively, a plurality of smaller drawers positioned between the actuators.

Figure 26:
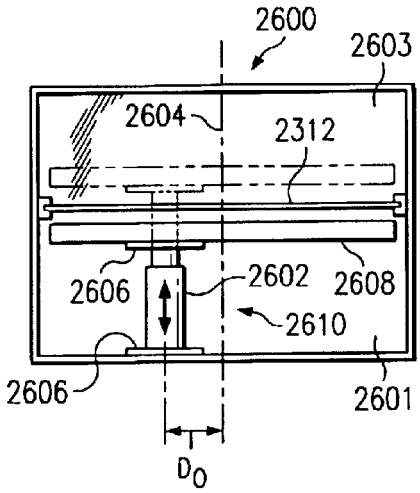
FIG. 26 is a rear elevation view, with the rear panel removed for purposes of illustration, of still another embodiment having an elevating mechanism that is positioned asymmetrically with respect to the lateral centerline of the case.

FIG. 26 illustrates an apparatus 2600 with a storage section 2601 and a display section 2603 wherein the elevating mechanism 2610 comprises a linear actuator 2602 which is offset from the apparatus centerline 2604 by a significant distance (denoted $D_O$). Mounting plates 2606 are used to rigidly attach the actuator 2602 to the housing and the platform 2608, thereby providing sufficient lateral and torsional stiffness to resist tipping of the platform, even when it is unevenly loaded. Such a configuration may be used when it is desired to provide a storage drawer having a width greater than one-half the case width in the space under the platform 2608.

Figure 27:
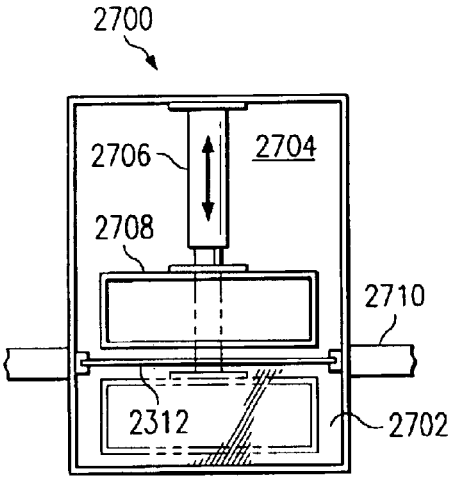
FIG. 27 is a rear elevation view, with the rear panel removed for purposes of illustration, of a further embodiment having the display section disposed vertically below the storage section.

FIG. 27 illustrates an "inverted" style apparatus 2700 wherein the display section 2702 is disposed below the storage section 2704, and an elevating mechanism 2706 is connected to the top of a hollow rectangular platform 2708. This configuration is suitable for mounting in a ceiling 2710 (e.g., in a museum), so that the secure storage section 2704 can be above the ceiling while the display area 2702 is in the room.

Figure 28:
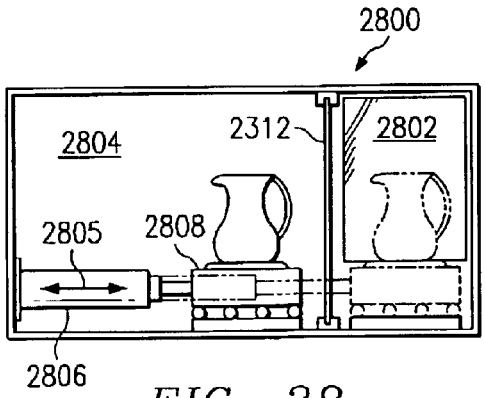
FIG. 28 is a rear elevation view, with the rear panel removed for purposes of illustration, of a yet another embodiment having the display section disposed horizontally adjacent to the storage section.

FIG. 28 illustrates a "horizontal" style apparatus 2800 wherein the display section 2802 is disposed horizontally adjacent to the storage section 2804, and the axis of movement 2805 of the elevating mechanism 2806 and of the platform 2808 is substantially horizontal. Note, while in this case the elevating mechanism 2806 actually serves to translate the platform 2808 rather than elevate it, the term elevating mechanism is retained for the sake of continuity.

It will be appreciated that many types of linear actuators are known in the art. Mechanical linear actuators include screw-type, rack and pinion type, and chain and sprocket type, all of which may be manually or electrically powered. Fluid powered linear actuators include hydraulic and pneumatic piston types. All of these types of linear actuators, as well as all other known types, are suitable for use in the security display case apparatus of the current invention. Of course, some types of actuators may be more preferred than others for reasons of cost, power requirements, etc.

Figure 29:
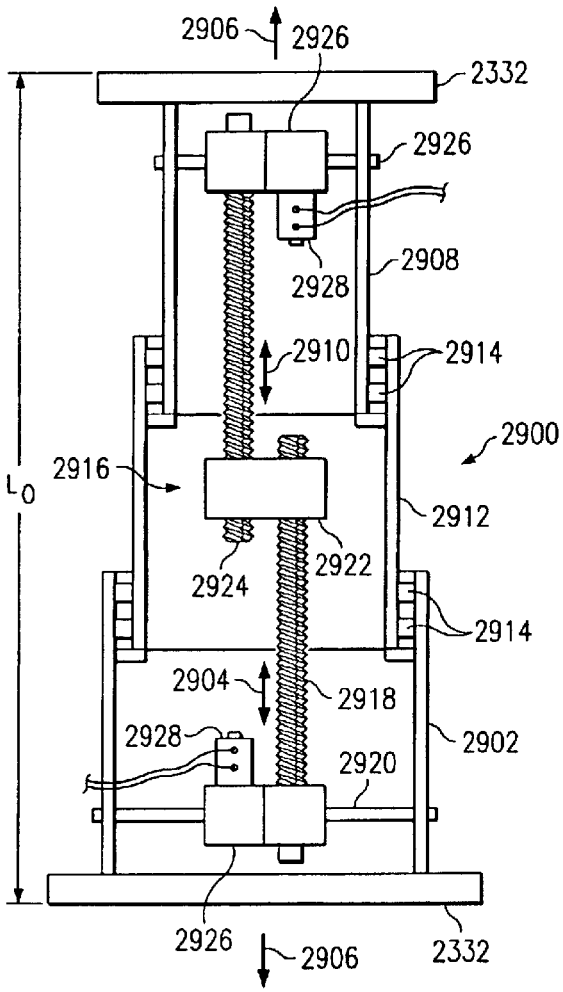
FIG. 29 is a cut-away view of a screw-type linear actuator.

Referring now to FIG. 29, there is illustrated one type of telescoping linear actuator particularly well suited for use in the current invention. Such actuators are readily available from commercial sources and are primarily used in making adjustable-height tables, computer stations and monitor platforms. The actuator 2900 comprises an outer tube member 2902 having a first longitudinal axis 2904 that defines the straight-line axis 2906 of the actuator. An inner member 2908 is provided having a second longitudinal axis 2910. The inner member 2908 is dimensioned to "telescope" within the outer tube member 2902 so as to maintain the first and second longitudinal axes 2904 and 2910 in parallel when moving between the extended configuration and the retracted configuration. While actuators having only two such telescoping members are available and suitable for use in many cases, in the embodiment shown the inner member 2908 actually telescopes within a third (intermediate) tube member 2912, which in turn telescopes within the outer tube member 2902. In this embodiment, all of the telescoping members 2902, 2908 and 2912 have a square cross section, allowing the actuator to resist torques applied about the straight line axis 2906. Telescoping members having other cross sections, e.g., rectangular, circular, hexagonal, etc. may also be used. Spacing pads 2914 are provided between the telescoping members to maintain them in alignment as they move.

Referring still to FIG. 29, a screw-type extending mechanism 2916 is connected between the outer tube member 2902 and the inner member 2908. When activated, the extending mechanism 2916 selectively extends and retracts the inner member 2908 with respect to the outer tube member 2902, thus changing the overall length $L_O$ of the actuator. In the embodiment illustrated in FIG. 29, the extending mechanism 2916 includes a first threaded shaft 2918 disposed substantially parallel to the straight-line axis 2906 and connected to the outer tube member 2902 by a bar 2920 so as to prevent relative translation along the straight-line axis 2906. A nut member 2922 operably engages the threaded shaft 2918 and is connected to the inner member 2908 so as to prevent relative translation there between along the straight-line axis. In this case, the nut member 2922 is connected to the inner member 2908 by a second threaded shaft 2924 operatively engaged to the nut member (in a second threaded hole) and a second bar 2926. Each threaded shaft 2918 and 2924 is operably connected to a gearbox 2926 and electric motor 2928. When the motors 2928 are activated in a first direction, the threaded shafts 2918 and 2924 rotate such that the shafts screw through the nut member 2922 in a direction that pushes apart the members 2902 and 2908, thus extending the linear actuator 2900 (i.e., increasing the value of $L_O$). Activating the motors 2928 in the opposite direction rotates the threaded shafts 2918 and 2924 such that both shafts screw through the nut member in a direction that pulls the members 2902 and 2908 toward one another, thus retracting the linear actuator 2900 (i.e., decreasing the value of $L_O$).

Figure 30:
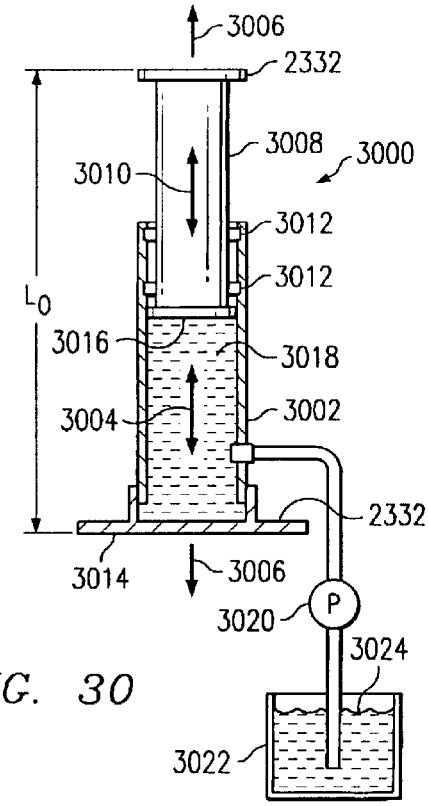
FIG. 30 is a cut-away view of a fluid-type linear actuator.

Referring now to FIG. 30, there is illustrated a fluid type linear actuator that is also suitable for use in the current invention. Linear actuator 3000 includes a outer tube member 3002 having a first longitudinal axis 3004 that defines the straight-line axis 3006 of the actuator. An inner member 3008 is provided having a second longitudinal axis 3010. The inner member 3008 is dimensioned to "telescope" within the outer tube member 3002 so as to maintain the first and second longitudinal axes 3004 and 3010 in parallel when moving between the extended configuration and the retracted configuration. The lower ends 3014 and 3016 of the outer tube member 3002 and the inner member 3008, respectively, are closed to form a cavity 3018 therebetween as shown. One or more seal ring 3012 may be provided to make a fluid-tight seal between the outer tube member 3002 and the inner member 3008. A fluid pump 3020 is operably connected to the fluid cavity 3018 and a reservoir 3022 filled with fluid 3024. The fluid 3024 may be water, oil or other hydraulic fluid when the actuator 3000 is a hydraulic actuator, and the fluid may be air or another gas when the actuator is a pneumatic actuator. Activating the pump 3020 to add fluid 3024 into the cavity 3018 extends the actuator linear actuator 3000 (i.e., increases the value of $L_O$), while removing fluid from the cavity retracts the actuator (i.e., decreases the value of $L_O$).

As previously discussed, in addition to providing a display section and a secure storage section, it is desirable that a security display case apparatus also provide "under-counter" storage space for storing items that do not need to be displayed. This additional storage should be accessible from the exterior of the security case, and preferably be isolated from the secure storage section.

Figure 31:
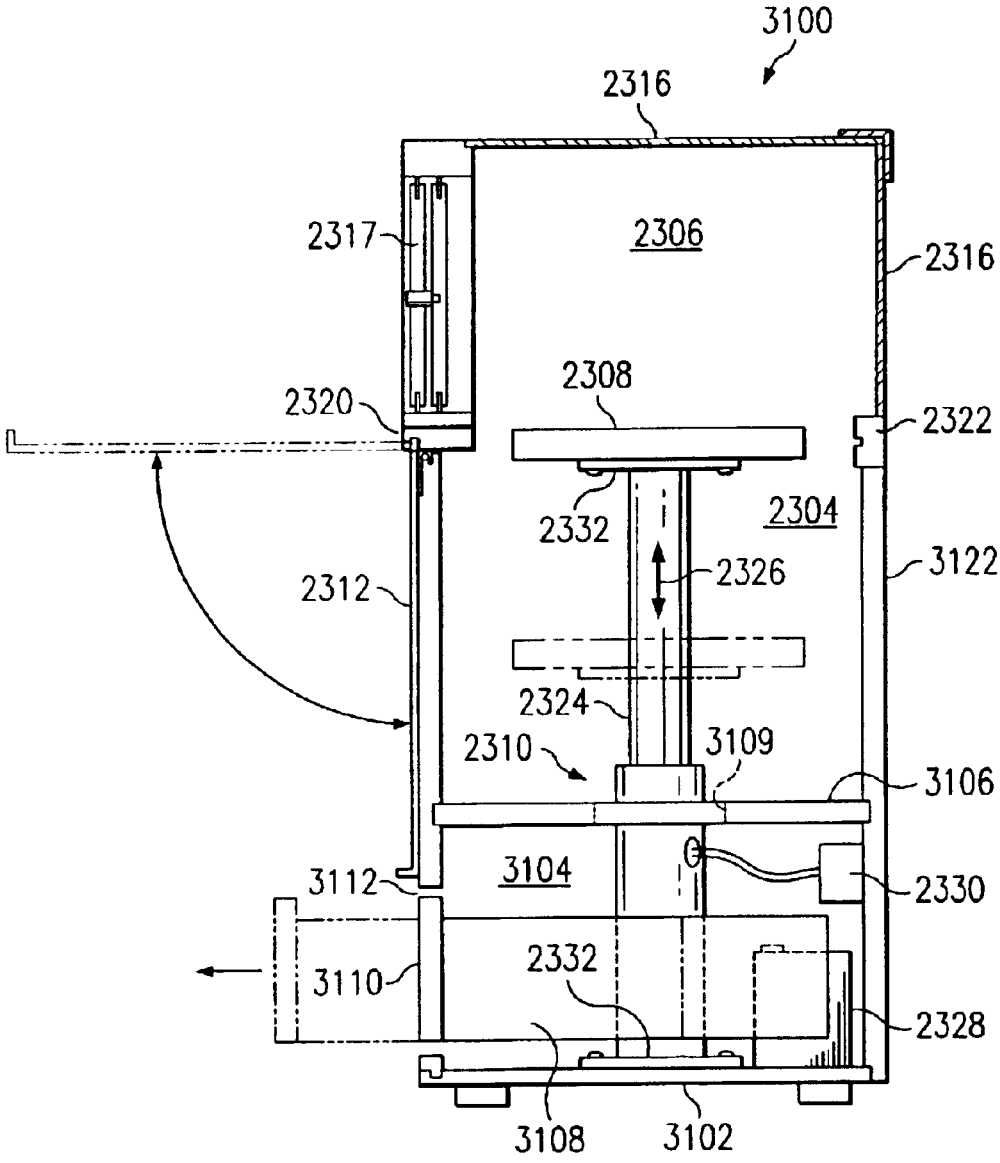
FIGS. 31–32 illustrate still another embodiment of a display case security apparatus wherein an external drawer section is included. Specifically.
Figure 32:
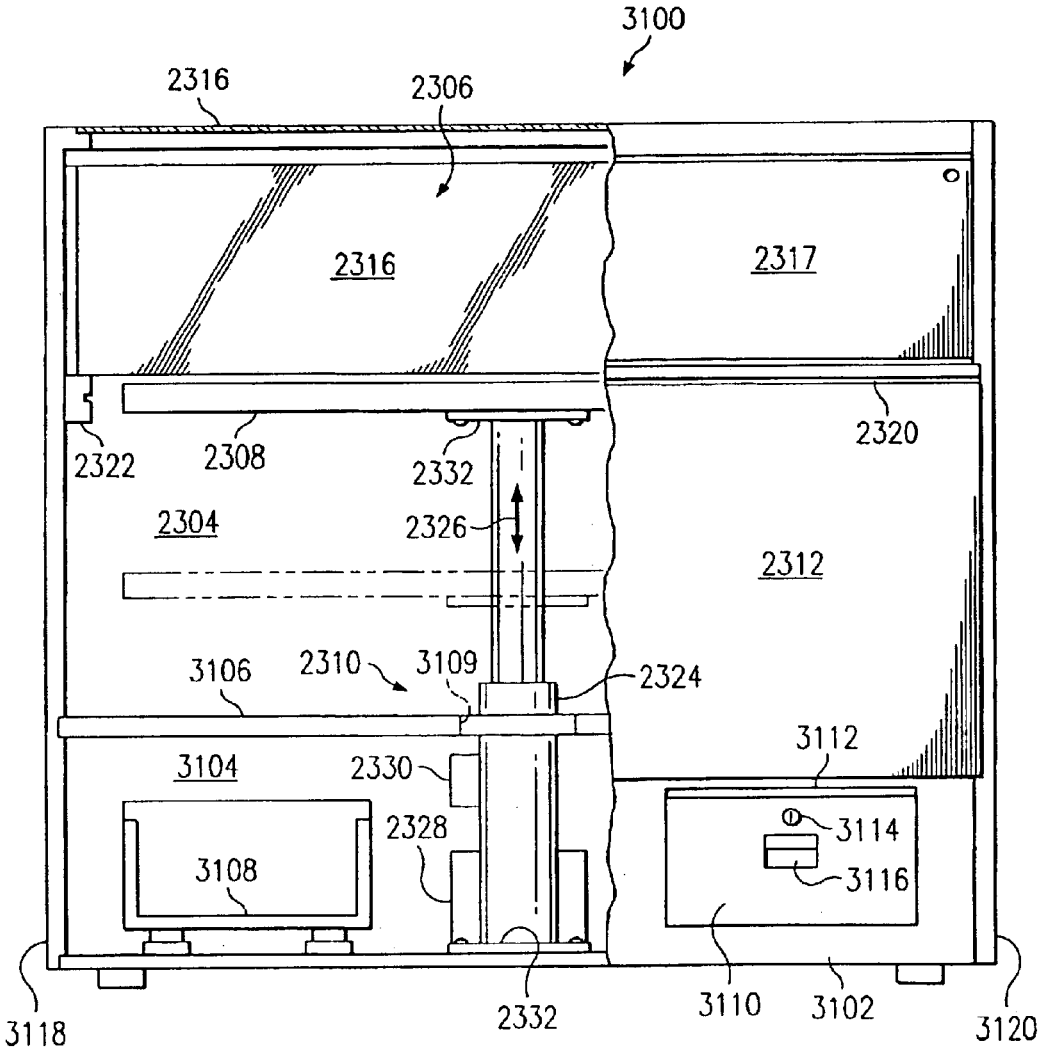

Referring now to FIGS. 31 and 32, there is illustrated a further embodiment of a display case security apparatus, this embodiment including under counter storage space in the form of an "external drawer section." The apparatus 3100 has a configuration substantially similar in many respects to the display case security apparatus 2300 previously described in connection with FIGS. 23 and 24, and therefore like reference number will be used to denote like elements. Unlike previous embodiments, however, the housing 3102 of this embodiment includes an external drawer section 3104 that is disposed adjacent the storage section 2304, but on the side opposite from the display section 2306. The external drawer section 3104 is separated from the storage section by a security wall 3106, and thus is only accessible from the exterior of housing 3102, in this case via passage 3112 in the lower rear portion of the case. In the embodiment shown, the external drawer section 3104 can be accessed regardless of the position of the platform 2308 or the closure 2312.

Preferably, at least one storage drawer 3108 is slidably mounted in the external drawer section 3104 so as to be accessible from the rear side of the housing 3102. In the embodiment shown, there are two storage drawers 3108, and each is provided with a face plate 3110 which fits flush within the opening 3112 of the rear exterior wall. Each face plate 3110 may be equipped with a lock 3114 for securing the storage drawer and a handle 3116 to facilitate its convenient opening. It will be appreciated that in some embodiments, the exterior walls of the storage section 2304 may be extend beyond that section to also serve as exterior walls for the display section 2306 and/or for the external drawer section 3104. For example, in the embodiment shown, the side exterior walls 3118 and 3120 constitute parts of the exterior walls for all three sections 2304, 2306 and 3104, and the front exterior wall 3122 constitutes a part of the exterior walls both the storage section and the external drawer section.

When an external drawer section 3104 is provided, the elevating mechanism 2310 may be mounted and positioned entirely within the storage section 2304 (not illustrated). Alternatively, as shown in FIG. 31, the elevating mechanism 2310 may have one end mounted to the housing 3102 in the external drawer section 3104, extend through a passageway 3109 in the security wall 3106, and have the opposite end attached to the platform 2308 in the storage section 2304. Each configuration has advantages and disadvantages. For example, positioning the elevating mechanism 2310 entirely within the storage section 2304 eliminates any intrusion of the mechanism into the external drawer section 3104, thus maximizing the potential under counter storage space. However, since the linear actuator 2324 must retract far enough to allow the platform 2308 and the goods displayed thereupon to completely enter the storage section 2304, then shorter linear actuators (typically having less "travel"), or more heavily telescoped linear actuators (typically more expensive) must be used.

On the other hand, allowing the elevating mechanism 2310 to extend into the external drawer section 3104 allows the use of longer linear actuators 2324 (typically having longer travel for a given cost), but it reduces the potential storage space in the external drawer section. In addition, it requires that a passageway 3109 be formed through the security wall 3106. However, by selecting the dimensions of the passageway 3109 to conform closely with the dimensions of the actuator 2324, the effective isolation of the storage section 2304 may be maintained.

In the embodiment illustrated, the elevating mechanism 2310 includes a single linear actuator 2324 mounted near the centerline of the case, and a pair of storage drawers 3108, one drawer being positioned on each lateral side of the actuator. As best seen in FIG. 31, the power source 2328 and controller 2330 maybe positioned in the unused space behind the actuator 2324. By combining the use of a linear actuator 2324 and the external drawer section 3104, the apparatus 3100 provides many desirable features in a single security display case.

Although several embodiments have been described in detail, it should be understood that various changes, substitutions and alterations can be made therein without departing from the spirit and scope of the invention as defined by the appended claims.

What is claimed is:

1. A display case security apparatus comprising:

a housing including a lower storage section and an upper display section disposed above the storage section, the storage section having an opaque exterior wall and the display section having an exterior wall that is at least partially transparent;

a platform disposed within tire housing for supporting articles to be displayed, the platform being selectively movable in the vertical direction between a first position, wherein any articles supported on the platform are in the display section of the housing, and a second position, wherein any articles supported on the platform ax, in the storage section of the housing;

an elevating mechanism mounted within the housing, the elevating mechanism including a linear actuator that is selectively extendable along a straight line axis between a retracted configuration and an extended configuration, the linear actuator being connection between the housing and the platform and positioned so that the straight line axis is oriented vertically, whereby the platform moves vertically between the first position and the second position when the linear actuator moves between the extended configuration and the retracted configuration, respectively; and a closure that is selectively interposed between the display section and the storage section when the platform is in the second position, whereby the platform and any articles supported thereon are enclosed within the storage section of the housing.

2. The display use security apparatus of claim 1, wherein the vertical footprint of the elevating mechanism does not change as the platform moves between the first position and the second position.

3. The display case security apparatus of claim 1, wherein the connection between the linear actuator and the platform prevents horizontal translation or tipping of the platform.

4. The display case security apparatus of claim 3, wherein the linear actuator is rigidly connected to the platform.

5. The display ease security apparatus of claim 3, wherein the connection between the linear actuator and the platform allows rotation about a vertical axis only.

6. The display case security apparatus of claim 1, wherein the housing further includes a external drawer section disposed below the storage section, the external drawer section being isolated from the storage section and accessible from the exterior of the housing regardless of the position of the platform.

7. The display case security apparatus of claim 6, wherein a portion of the elevating mechanism is disposed in the external drawer section and extends vertically upward into the storage section of the housing.

8. The display case security apparatus of claim 7, further comprising a security wall disposed between the storage section and the external drawer section of the housing, the security wall having a vertical passage way formed there through dimensioned to admit only the elevating mechanism.

9. The display case security apparatus of claim 6, further comprising a least one storage drawer slidably mounted in the external drawer section and accessible from the exterior of the housing.

10. The display case security apparatus of claim 9, wherein: the linear actuator is centered side-to-aide wider the platform and extends into the external drawer section; and a least one storage drawer is slidably mounted in the external drawer section on each side of the linear actuator, the storage drawers both being accessible from the exterior of the housing.

11. The display case security apparatus of claim 9, wherein:

the elevating mechanism comprises two linear actuators spaced-apart under the platform and extending into the external drawer section; and at least one storage drawer is slidably mounted in the external drawer section between the two linear actuators, the storage drawer being accessible from the exterior of the housing.

12. The display case security apparatus of claim 1, wherein the maximum lateral width of the elevating mechanism is less than about 25% of the maximum lateral width of the platform.

13. The display case security apparatus of claim 12, wherein the maximum lateral width of the elevating mechanism is less than about 15% of the maximum lateral width of the platform.

14. A display case security apparatus comprising:

a housing including a storage section and a display section disposed adjacent the storage section, the display section having an exterior wall that is as least partially transparent;

a platform disposed within the housing for supporting articles to be displayed, the platform being selectively movable along an axis of movement between a first position, wherein any articles supported on the platform are positioned in the display section of the housing, and a second position, wherein any articles supported on the platform are positioned in the storage section of the housing;

at least one linear actuator that is selectively extendable along a straight line axis between a retracted position and an extended position, the linear actuator being connected between the housing and the platform and oriented so that the straight line axis is parallel to the axis of movement of the platform, whereby moving the linear actuator between the extended and retracted positions moves the platform between the flint and second positions, respectively; and a closure that is selectively interposed between the display section and the storage section when the platform is in the second position, whereby the platform and any articles supported thereon are enclosed within the storage section of the housing.

15. The display case security apparatus of claim 14, wherein the linear actuator further comprises:

an outer tube member having a first longitudinal axis that defines the straight-line axis of the actuator;

a inner member having a second longitudinal axis, the inner member being dimensioned to telescope within the outer tube member so as to maintain the first and second longitudinal axes in parallel when moving between the extended configuration and the retracted configuration; and an extending mechanism that selectively extends and retracts the inner member with respect to the outer tube member.

16. The display case security apparatus of claim 15, wherein the extending mechanism further comprises:

a threaded shaft disposed substantially parallel to the straight-line axis and connected to one of the inner member and outer tube member so as to prevent relative translation there between along the straight-line axis:

a nut member operably engaging the threaded shaft and connected to the other of the inner member and outer tube member so as to prevent relative translation there between along the straight-line axis; and whereby relative rotational motion between the threaded shaft and the nut member in a first direction extends the linear actuator and relative rotational motion between the threaded shaft and the nut member in the opposite direction retracts the linear actuator.

17. The display case security apparatus of claim 15, wherein the extending mechanism further comprises:

a first threaded shaft disposed substantially parallel to the straight-line axis and connected to one of the inner member and outer tube member so as to prevent relative translation there between along the straight-line axis;

a second threaded haft disposed substantially parallel to the straight-line axis and connected to the other of the inner member and outer tube member so as to prevent relative translation there between along the straight-line axis;

a nut member operably engaging the first threaded shaft and the second threaded shaft; and whereby relative rotational motion between the threaded shafts and the nut member in a first direction extends the linear actuator and relative rotational motion between the threaded shafts and the nut member in the opposite direction retracts the linear actuator.

18. The display case security apparatus of claim 15, wherein the extending mechanism further comprises a hydraulic pump for selectively adding or withdrawing fluid from a chamber formed between the outer tube member and the inner member.

19. The display case security apparatus of claim 15, wherein the extending mechanism further comprises a pneumatic pump for selectively adding or withdrawing air from a chamber formed between the outer tube member and the inner member.

20. The display case security apparatus of claim 14, wherein the display section is positioned above the storage section and the axis of movement of the platform is substantially vertical.

21. The display case security apparatus of claim 14, wherein the display section is positioned below the storage section and the axis of movement of the platform is substantially vertical.

22. The display case security apparatus of claim 14, wherein the display section is positioned horizontally adjacent to the storage section and the axis of movement of the platform is substantially horizontal.

23. A display case security apparatus comprising:

a housing having a front side and a rear side and including a storage section and a display section, the display section being disposed in a first direction relative to the storage section and having an exterior wall that is at least partially transparent;

a platform disposed within the housing for supporting articles to be displayed, the platform being selectively movable between a first position, wherein any articles supported on the platform are in the display section of the housing, and a second position, wherein any articles supported on the platform are in the storage section of the housing;

an elevating mechanism mounted within the housing and connected between the housing and the platform, the elevating mechanism including a linear actuator being selectively movable between an extended configuration and a retracted configuration, whereby the platform moves between the first position and the second position when the elevating mechanism moves between the extended configuration and the retracted configuration, respectively;

a closure that is selectively interposed between the display section and the storage section when the platform is in the second position, whereby the platform and any articles supported thereon are enclosed within the storage section of the housing;

a external drawer section disposed in a second direction relative to the storage section, the second direction being opposite the first direction, the external drawer section being isolated from the storage section and accessible from the exterior of the housing regardless of the position of the platform; and at least one storage drawer slidably mounted in the external drawer section and accessible from the exterior of the housing.

24. The display case security apparatus of claim 23, wherein a portion of the elevating mechanism is disposed in the external drawer section and extends into the storage section of the housing.

25. The display case security apparatus of claim 24, further comprising a security wall disposed between the storage section and the external drawer section of the housing, the security wall having a passageway formed there through dimensioned to admit only the elevating mechanism.

26. The display case security apparatus of claim 23, wherein:

the elevating mechanism is centered side-to-side with respect to the platform and extends into the external drawer section; and at least one storage drawer is slidably mounted in the external drawer section on each side of the linear actuator, the storage drawers both being accessible from the exterior of the housing.

27. The display case security apparatus of claim 23, wherein the maximum lateral width of the elevating mechanism, regardless of its configuration, is less than about 25% of the maximum lateral width of the platform.

* * * * *

UNITED STATES PATENT AND TRADEMARK OFFICE

CERTIFICATE OF CORRECTION

PATENT NO. : 6,851,770 B2
DATED : February 8, 2005
INVENTOR(S) : Canedy et al.

It is certified that error appears in the above-identified patent and that said Letters Patent is hereby corrected as shown below:

Column 15,
Line 66, delete “tire” and insert therefor -- the --;

Column 16,
Line 5, delete “ax,” and insert therefor -- are --;
Line 11, delete “connection” and insert therefor -- connected --;
Line 23, delete “use” and insert therefor -- case --;
Line 32, delete “ease; and insert therefor -- case --;
Line 48, delete “passage way” and insert thereby -- passageway --;
Lines 48-49, delete “there through” and insert therefor -- therethrough --;
Line 52, after “comprising” delete “a” and insert therefor -- at --;
Line 56, delete “side-to-aide wider” and insert therefor -- side-to-side under --;
Line 59, delete “a least” and insert therefor -- at least --;

Column 17,
Line 16, delete “as” and insert therefor -- at --;
Line 34, delete “flint” and insert therefor -- first --;
Line 60, after “axis” delete “:” and insert therefor -- ; --;

Column 18,
Line 11, delete “haft” and insert therefor -- shaft --; and

Column 20,
Lines 2-3, delete “there through” and insert therefor -- therethrough --.

Signed and Sealed this

Tenth Day of May, 2005

JON W. DUDAS
*Director of the United States Patent and Trademark Office*